US007914732B2

(12) United States Patent
Takabayashi et al.

(10) Patent No.: US 7,914,732 B2
(45) Date of Patent: Mar. 29, 2011

(54) FERRITIC STAINLESS STEEL CAST IRON, CAST PART USING THE FERRITIC STAINLESS STEEL CAST IRON, AND PROCESS FOR PRODUCING THE CAST PART

(75) Inventors: Hiroyuki Takabayashi, Nagoya (JP); Shigeki Ueta, Nagoya (JP); Tetsuya Shimizu, Nagoya (JP); Toshiharu Noda, Nagoya (JP)

(73) Assignee: Daido Tokushuko Kabushiki Kaisha (JP)

( * ) Notice: Subject to any disclaimer, the term of this patent is extended or adjusted under 35 U.S.C. 154(b) by 225 days.

(21) Appl. No.: 11/709,863

(22) Filed: Feb. 23, 2007

(65) Prior Publication Data

US 2007/0215252 A1 Sep. 20, 2007

(30) Foreign Application Priority Data

Feb. 23, 2006 (JP) ..... 2006-047354
Feb. 23, 2006 (JP) ..... 2006-047355

(51) Int. Cl.
*C22C 38/22* (2006.01)
*C22C 38/24* (2006.01)
*C22C 38/26* (2006.01)

(52) U.S. Cl. ..... 420/69; 420/67; 420/68; 420/61; 148/325; 148/605

(58) Field of Classification Search ..... 148/325, 148/605; 420/60, 61, 67, 69
See application file for complete search history.

(56) References Cited

U.S. PATENT DOCUMENTS 4,360,381 A * 11/1982 Tarutani et al. ..... 420/42
4,456,483 A * 6/1984 Deverell et al. ..... 420/63
5,152,850 A * 10/1992 Takahashi et al. ..... 148/325
5,202,088 A * 4/1993 Genma et al. ..... 420/40
5,254,307 A * 10/1993 Hasegawa et al. ..... 420/66
5,268,142 A * 12/1993 Hasegawa et al. ..... 420/66
5,582,657 A * 12/1996 Watanabe et al. ..... 148/325

FOREIGN PATENT DOCUMENTS

EP 492674 7/1992

(Continued)

OTHER PUBLICATIONS

English abstract of French patent 2644207, Ledouaron et al., Sep. 14, 1990.*

(Continued)

*Primary Examiner* — Deborah Yee
(74) *Attorney, Agent, or Firm* — Bacon & Thomas, PLLC

(57) ABSTRACT

The present invention provides: a ferritic stainless steel cast iron including: Fe as a main component; C: 0.20 to 0.40 mass %; Si: 1.00 to 3.00 mass %; Mn: 0.30 to 3.00 mass %; Cr: 12.0 to 30.0 mass %; and one of Nb and V, or both of Nb and V in total: 1.0 to 5.0 mass %, the ferritic stainless steel cast iron satisfying the following formula (1):

$$1400 \leqq 1562.3-\{133WC+14WSi+5WMn+10(WNb+WV)\} \leqq 1480 \quad (1)$$

wherein, WC (mass %), WSi (mass %), WMn (mass %), WCr (mass %), WNb (mass %), WV (mass %) and WCu (mass %) are contents of C, Si, Mn, Cr, Nb, V and Cu, respectively; a process for producing a cast part from the ferritic cast steel; and the cast part.

55 Claims, 5 Drawing Sheets

FOREIGN PATENT DOCUMENTS

| | | | |
|---|---|---|---|
| EP | 635581 | | 1/1995 |
| EP | 1219720 | | 7/2002 |
| JP | 401180769 | * | 7/1989 |
| JP | 05-320830 | | 12/1993 |
| JP | 07-157848 | * | 6/1995 |
| JP | 08-225898 | | 9/1996 |
| JP | 409118962 | * | 5/1997 |
| JP | 2000-204946 | | 7/2000 |
| JP | 2002-309935 | * | 10/2002 |

OTHER PUBLICATIONS

English abstract of Korean Patent 2003-024334, Kim , Mar. 26, 2003.*

Machine-English translation of Japanese patent 2002-309935, Akiyama et al., Oct. 23, 2002.*

Machine-English translation of Japanese patent 07-157848, Akiyama et al., Jun. 20, 1995.*

* cited by examiner

FERRITIC STAINLESS STEEL CAST IRON, CAST PART USING THE FERRITIC STAINLESS STEEL CAST IRON, AND PROCESS FOR PRODUCING THE CAST PART

FIELD OF THE INVENTION

The invention relates to a heat-resistant ferritic stainless steel cast iron, a cast part using the ferritic stainless steel cast iron, and a process for producing the cast part.

BACKGROUND OF THE INVENTION

For components of an exhaust system of an automobile engine, such as an exhaust manifold and a turbine housing, spheroidal graphite cast iron and high-Si spheroidal graphite cast iron have been hitherto used. In some high-powered engines, since the exhaust gas temperature is high and even high-Si spheroidal graphite cast iron has insufficient endurance, a weld structure of stainless steel sheets, "Niresist" cast iron and ferritic stainless cast iron is adopted. Recently, as high-powered engines of automobiles have been further developed, demand for cleaning automobile exhaust gas has increased. In particular, in order to speedily clean up an exhaust gas when an engine is started, the exhaust gas has to be speedily heated to a temperature where an exhaust gas cleaning device operates. Therefore, thinning and weight reduction of the exhaust system components have become demanded because the amount of heat stripped by exhaust system components such as an exhaust manifold and a turbine housing located further to the engine side than an exhaust gas cleaning device should be reduced to the extent possible. However, in thin casts, owing to the thinning, the strength against the thermal stress becomes insufficient and the surface temperature goes up, and therefore existing spheroidal graphite cast iron is insufficient in thermal fatigue characteristics and in oxidation resistance. As the result, casts of stainless steel cast irons are partially being used (Reference 1).

[Reference 1] JP 08–225898

However, when a cast of the stainless steel cast iron of Reference 1 is used for parts such as exhaust system components, in an environment of high-temperature and high-C potential, the cast part is carburized and decreased in thermal fatigue resistance and workability. Besides, when the cast part is used in the exhaust system component of a diesel engine, a S component contained in light oil that is a fuel is burned to generate a sulfuric acid based component, and the sulfuric acid based component condenses on an inner surface of the component when the exhaust gas is cooled to tend to accelerate the corrosion (i.e., so-called sulfuric acid dew corrosion).

SUMMARY OF THE INVENTION

Objects of the invention are to provide a ferritic stainless steel cast iron, a process for producing a cast part comprising the ferritic stainless steel cast iron and having an excellent thermal fatigue characteristic and the oxidation resistance, as well as excellent resistance to the sulfuric acid dew corrosion, the resistance to carburizing, and the machinability.

The present inventors have found that the foregoing objects can be achieved by the following ferritic stainless steel cast iron, cast parts, and process for producing the same.

Accordingly, the present invention provides a ferritic stainless steel cast iron comprising: Fe as a main component; C: 0.20 to 0.40 mass %; Si: 1.00 to 3.00 mass %; Mn: 0.30 to 3.00 mass %; Cr: 12.0 to 30.0 mass %; and one of Nb and V, or both of Nb and V in total: 1.0 to 5.0 mass %, the ferritic stainless steel cast iron satisfying the following formula (1):

$$1400 \leqq 1562.3-\{133WC+14WSi+5WMn+10(WNb+WV)\} \leqq 1480 \quad (1)$$

wherein, WC (mass %), WSi (mass %), WMn (mass %), WNb (mass %), and WV (mass %) represent contents of C, Si, Mn, Nb, and V, respectively.

Preferably, the ferritic stainless steel cast iron according to the invention satisfies the following formula (2):

$$900 \leqq -31.6-200WC+143WSi-111WMn+67WCr-90(WNb+WV) \quad (2)$$

and WCr represents content of Cr in mass %.

In another preferred embodiment, the ferritic stainless steel cast iron according to the invention satisfies the following formula (3):

$$1050 \leqq -31.6-200WC+143WSi-111WMn+67WCr-90(WNb+WV) \quad (3)$$

Preferably, the ferritic stainless steel cast iron according to the invention satisfies the following formula (4):

$$792+47WC-138WSi-16WCr-23(WNb+WV) \leqq 300 \quad (4)$$

The ferritic stainless steel cast iron according to the invention may further contain 0.02 to 2.00 mass %, Cu, in which case the ferritic stainless steel cast iron satisfies the following formula (5):

$$3WCr+118WCu>55 \quad (5)$$

The ferritic stainless steel cast iron according to the invention may further comprise at least one member selected from the group consisting of: W: 0.10 to 5.00 mass %; Ni: 0.10 to 5.00 mass %; Co: 0.01 to 5.00 mass %; and Mo: 0.05 to 5.00 mass %.

The ferritic stainless steel cast iron according to the invention may further comprise at least one member selected from the group consisting of: S: 0.01 to 0.50 mass %; N: 0.01 to 0.15 mass %; and P: 0.50 mass % or less.

The ferritic stainless steel cast iron according to the invention may further comprise at least one member selected from the group consisting of: B: 0.005 to 0.100 mass %; and Ca: 0.005 to 0.100 mass %.

The ferritic stainless steel cast iron according to the invention may further comprise at least one member selected from the group consisting of: Ta: 0.01 to 1.00 mass %; Ti: 0.01 to 1.00 mass %; Al: 0.01 to 1.00 mass %; and Zr: 0.01 to 0.20 mass %.

The ferritic stainless steel cast iron according to the invention may further comprise one or more of Sc, Y, La, Ce, Pr, Nd, Sm, Eu, Gd, Tb, Dy, Ho, Er, Tm, Yb and Lu, totaling 0.005 to 0.100 mass %.

The present invention also provides a process for producing a cast part, the process comprising: low-pressure casting a molten ferritic stainless steel cast iron of a composition described above into a sand mold having the shape of the cast part. The process preferably produces a cast part having a thin portion with a thickness of 1 to 5 mm.

The present invention also includes a cast part comprising a ferritic stainless steel cast iron of a composition described above.

The cast part according to item 13, wherein the cast part comprises a thin portion having a thickness of 1 to 5 mm.

In the invention, "steel having Fe as a main component" means that the balance of the steel composition, in addition to the various alloying elements mentioned in the specification is Fe and unavoidable impurities.

In the ferritic stainless steel cast iron of the invention, the content of Cr is heightened to improve the oxidation resistance at high temperatures. Furthermore, since a balance between C and Si is established to properly lower the melting point of steel, the fluidity of molten metal suitable for precision casting of a thin shape can be secured. Furthermore, the addition of Si, Cr, Nb and V improves the resistance to carburizing, thermal fatigue characteristic, and machinability of the cast. Furthermore, when an appropriate amount of Cu as indicated above is added, resistance against corrosion (in particular, sulfuric acid dew corrosion) can be greatly enhanced, and then the cast is well suited to apply as a part to repeatedly use an exhaust gas. In particular, it can be effectively used as an exhaust system component of a diesel engine that uses sulfur-containing light oil as a fuel. Besides, when a low-pressure casting method where, by use of a sand mold having gas permeability, the inside of the cavity is depressurized to suck the molten ferritic stainless steel cast iron into the cavity, a sufficient casting flow can be secured even in a narrow cavity. Accordingly, together with an improvement in the fluidity of molten metal of the ferritic stainless steel cast iron, even a cast part having a thin portion with a thickness of 1 to 5 mm can be produced while suppressing the structural defects such as sand intrusion and voids.

The cooling capacity of the sand mold is relatively small compared with, for instance, a metal mold or a water-cooled mold. However, when a cast part having a thin portion having a thickness of 1 to 5 mm is produced, the relative contact area per unit volume of the molten metal and the sand mold becomes larger since the thickness of the thin portion is very small. Accordingly, the speed of cooling down to 800° C. in the thin portion can be set relatively large such as 20 to 100° C./min. As the result, a cast part using a ferritic stainless steel cast iron of the invention can be formed into a shape having a thin portion restricted in thickness to 1 to 5 mm. Besides, an average grain size of a ferrite phase in the thin portion can be reduced to 50 to 400 μm for the first time.

Furthermore, since the thickness of the thin portion of the cast part is restricted to 1 to 5 mm, it contributes to a large savings in the weight of the part. Furthermore, owing to an improvement in the cooling speed during the casting due to the thickness setting of the thin portion, the average grain size of the ferrite phase can be reduced to as small as 50 to 400 μm and the casting segregation as well can be reduced. Since the average grain size can be reduced, the proof stress, the tensile strength and the elongation to breakage (resultantly, the toughness and the shock-resistance) at high temperatures of the thin portion all can be improved and the fatigue strength at high temperatures can be improved as well. Still furthermore, when the thickness of the thin portion is reduced as mentioned above, parts can be further reduced in weight.

Incidentally, when the thickness of the thin portion is less than 1 mm, even when the low-pressure casting method is used, sufficient reliability of the thin portion cannot be secured. On the other hand, when the thickness of the thin portion exceeds 5 mm, the weight savings for parts due to the thinning becomes inconspicuous, cooling speed cannot be sufficiently improved with the sand mold, and the average grain size of the thin portion becomes difficult to maintain below the upper limit value mentioned above. On the other hand, in the low-pressure casting method with the sand mold, it is difficult to make the average grain size of ferrite less than 50 μm and, when the average grain size of ferrite exceeds 400 μm, an improvement in the high temperature strength is not conspicuous. Accordingly, the thickness of the thin portion is preferably set at 1.5 to 4.0 mm and more preferably at 2.0 to 4.0 mm. Furthermore, the average grain size of ferrite in the thin portion is preferably set at 80 to 350 μm.

As to the mechanical characteristics of a material that constitutes the thin portion, at 900° C., for instance, the 0.2% proof strength of 15 to 45 MPa, the tensile strength of 35 to 65 MPa and the elongation of 90 to 160% can be secured. Furthermore, at 1000° C., for instance, the 0.2% proof strength of 10 to 25 MPa, the tensile strength of 20 to 35 MPa and the elongation of 90 to 160% can be secured.

The thin cast part of the invention can be used as a component of an exhaust system of a gasoline engine or a diesel engine and can contribute to a large savings in the weight and an improvement in the endurance of engines. In particular, in the case of a diesel engine where an engine temperature and internal pressure are high, spillover effects are large.

Furthermore, the thin cast part of the invention may be formed to have a thick portion (t'>5 mm), such as an attaching flange, in addition to the thin portion (1 mm≦t≦5 mm), as shown in FIG. 4. However, from the viewpoint of savings in the weight of parts, such thick portions are desirably 70% or less of the total weight of the parts.

In what follows, reasons for limiting compositions of the respective elements in the ferritic stainless steel cast iron used in the invention will be described.

C: 0.20 to 0.40 mass %

The element C works so as to lower the melting point of a cast steel to improve the fluidity of the molten metal during a casting operation and also to increase the high temperature strength. However, when it is contained less than the lower limit value, the fluidity during the casting of the molten metal is decreased, and, even when the low-pressure casting method is adopted, it becomes difficult to form a good quality thin portion. Furthermore, in that case, the cast part is apt to be carburized since the difference in C potential between the ambient atmosphere and that in the interior of the cast part becomes large. The lower limit value of C is preferably set at 0.30 mass %. On the other hand, when it is contained exceeding the upper limit value, since a $\alpha \rightarrow \gamma$ transformation (ferrite→austenite) temperature becomes low and a deformation of parts owing to the transformation used in a high temperature becomes conspicuous, the usable upper limit temperature is significantly lowered. Furthermore, the amount of carbide formation becomes excessive and thereby the machinability is decreased. Furthermore, in that case, the amount of carburizing increases since an amount of dissolved C in a temperature area for forming austenite become large. The upper limit value of C is preferably set at 0.37 mass %.

According to one preferred embodiment, the minimum amount of C present in the cast steel is at least 1/10 of the smallest non-zero amount used in the examples of the developed cast steels as summarized in Tables 1 to 3. According to a further embodiment, the minimum amount of C present in the cast steel is the smallest non-zero amount used in the examples of the developed cast steels as summarized in Tables 1 to 3. According to yet another embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Si: 1.00 to 3.00 mass %

The element Si works so as to stabilize ferrite, elevate a $\alpha \rightarrow \gamma$ transformation temperature, lower the melting point of steel to improve the fluidity of the molten metal and suppress casting defects. Furthermore, Si contributes to improvement in the high temperature strength and the oxidation resistance.

Si also contributes to improvement in the resistance to carburizing and the machinability. However, when it is contained less than the lower limit value, the advantage becomes insufficient. The lower limit value of Si is preferably set at 1.50 mass % and more preferably 2.00 mass %. Furthermore, when its amount exceeds the upper limit value, the ductility (elongation) of steel is decreased and susceptibility to casting cracks is increased. Accordingly, the upper limit value of Si is preferably set at 2.50 mass %.

According to one preferred embodiment, the minimum amount of Si present in the cast steel is at least 1/10 of the smallest non-zero amount used in the examples of the developed cast steels as summarized in Tables 1 to 3. According to a further embodiment, the minimum amount of Si present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Mn: 0.30 to 3.00 mass %

The element Mn contributes to improvement in the oxidation resistance. However, when it is present in an amount less than the lower limit value, that advantage becomes insufficient. Furthermore, when the upper limit is exceeded, since a $\alpha \rightarrow \gamma$ transformation temperature becomes lower, the usable upper limit temperature is greatly lowered. The upper limit value of Mn is preferably set at 2.00 mass % and more preferably at 1.00 mass %.

According to a preferred embodiment, the minimum amount of Mn present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Cr: 12.0 to 30.0 mass %

The element Cr is a fundamental element for improving oxidation resistance, corrosion resistance and sulfuric acid corrosion resistance of steel and also elevates the $\alpha \rightarrow \gamma$ transformation temperature. However, when it is present in an amount less than the lower limit value, these advantages become insufficient. The lower limit value of Cr is preferably set at 15.0 mass %. Furthermore, when Cr is present in an amount exceeding the upper limit value, the thermal fatigue resistance is largely decreased owing to the formation of coarse carbide. The upper limit value of Cr is preferably set at 26.0 mass % and more preferably at 22.0 mass %.

According to one preferred embodiment, the minimum amount of Cr present in the cast steel is at least 1/10 of the smallest non-zero amount used in the examples of the developed cast steels as summarized in Tables 1 to 3. According to a further embodiment, the minimum amount of Cr present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

One of Nb and V, or both of Nb and V in total: 1.0 to 5.0 mass %

Elements Nb and V elevate the $\alpha \rightarrow \gamma$ transformation temperature and lower the melting point of steel to improve the fluidity of the molten metal. Furthermore, these elements also contribute to improve the resistance to carburizing. However, when the elements are contained in total less than the lower limit value, the advantage becomes insufficient. The lower limit value of one of Nb and V or both of Nb and V in total is preferably set at 1.30 mass %. Furthermore, when these elements are contained exceeding the upper limit value, owing to generation of coarse carbide, the thermal fatigue resistance is largely decreased. The upper limit value of one of Nb and V or both of Nb and V in total is preferably set at 3.5 mass % and more preferably at 2.0 mass %.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

The composition of the ferritic stainless steel cast iron of the invention preferably satisfies the following formula (1):

$$1400 \leqq 1562.3-\{133WC+14WSi+5WMn+10(WNb+WV)\} \leqq 1480 \quad (1)$$

wherein that WC (mass %), WSi (mass %), WMn (mass %), WCr (mass %), WNb (mass %), WV (mass %) and WCu (mass %) are the contents of C, Si, Mn, Cr. Nb, V and Cu, respectively.

More preferably, the composition of ferritic stainless steel cast iron of the invention further satisfies the following formula (2):

$$900 \leqq -31.6-200WC+143WSi-111WMn+67WCr-90(WNb+WV) \quad (2)$$

Most preferably, the composition of ferritic stainless steel cast iron of the invention satisfies the following formula (3):

$$1050 \leqq -31.6-200WC+143WSi-111WMn+67WCr-90(WNb+WV) \quad (3)$$

Furthermore, it is more preferable that the composition of ferritic stainless steel cast iron of the invention further satisfies the following formula (4):

$$792+47WC-138WSi-16WCr-23(WNb+WV) \leqq 300 \quad (4)$$

Preferably, the composition of ferritic stainless steel cast iron of the invention further satisfies the following formula (5):

$$3WCr+118WCu>55 \quad (5)$$

The formula (1) restricts the melting point of the steel. When the formula (1) exceeds the upper limit value, the melting point becomes too high and the casting temperature has to be set higher accordingly. When the casting temperature becomes too much higher, the binding force of a casting mold is decreased owing to deterioration of the casting mold (sand+binder), and accordingly, the so-called sand intrusion where sand mingles in the cast tends to occur. When there is sand intrusion, the tool life during a cutting operation is shortened and the product itself becomes highly likely to be judged as defective. On the other hand, when the formula (1) becomes less than the lower limit value, the advantage of reducing the melting point saturates and, accordingly, the cost is increased by an increment equal to the cost of the additional amount of alloying element.

The formula (2) stipulates a $\alpha \rightarrow \gamma$ transformation temperature and, in order to secure good thermal fatigue characteristics at high temperatures, the lower limit value thereof is set at 900° C. so that the transformation is avoided to the extent possible in the temperature range of the casting. Furthermore, when the formula (3) is also satisfied, the $\alpha \rightarrow \gamma$ transformation temperature can be furthermore elevated.

The formula (4) is a relational expression regarding components that affect the resistance to carburizing. The contents of C, Si, Cr, Nb and V are set so as to satisfy the formula (4) to have a hardness of 300 HV on the outermost surface.

Besides, the resistance to sulfuric acid dew corrosion can be secured by setting the relative amounts of the alloying elements to satisfy the formula (5).

Other accessory elements can be optionally contained in the ferritic stainless steel cast iron as follows:

Cu: 0.02 to 2.00 mass %

The element Cu lowers the melting point of steel and improves its castability, and suppresses the structural defects such as the sand intrusion from occurring. Furthermore, it largely enhances the corrosion resistance (in particular, sulfuric acid dew corrosiveness). In particular, it is an additive element that can be effectively added in a cast part applied as a part to repeatedly use an exhaust gas and an exhaust system part of a diesel engine. However, when it is contained less than the lower limit value, the advantage becomes insufficient. The lower limit value of Cu is preferably set at 0.10 mass %. Furthermore, when it is contained exceeding the upper limit value, a $\alpha \rightarrow \gamma$ transformation temperature becomes low and thereby the usable upper limit temperature is lowered. The upper limit value of Cu is preferably set at 1.50 mass % and more preferably set at 1.00 mass %.

According to one preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

W: 0.10 to 5.00 mass %

The element W which dissolves in a steel matrix increases the high temperature strength. However, when it is contained less than the foregoing lower limit value, the advantage thereof becomes insufficient. The lower limit value of W is preferably set at 0.50 mass %. Furthermore, when it is contained exceeding the upper limit value, the ductility of steel is lowered to result in deterioration of the shock-resistance. The upper limit value of W is preferably set at 3.00 mass % and more preferably at 0.94 mass %.

According to one preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Ni: 0.10 to 5.00 mass %

The element Ni which dissolves in a steel matrix increases the high temperature strength. However, when it is contained less than the foregoing lower limit value, the advantage thereof becomes insufficient. When it is contained exceeding the upper limit value, the $\alpha \rightarrow \gamma$ transformation temperature becomes lower, resulting in lowering the upper limit for a usable temperature. The upper limit value of Ni is preferably set at 3.00 mass % and more preferably at 1.00 mass %.

According to one preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Co: 0.01 to 5.00 mass %

The element Co dissolves in a steel matrix to increase the high temperature strength. However, when it is contained less than the foregoing lower limit value, the advantage thereof becomes insufficient. The lower limit value of Co is preferably set at 0.05 mass %. Furthermore, since Co is an expensive element, the upper limit value is set as mentioned above. The upper limit value of Co is preferably set at 3.00 mass %.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Mo: 0.05 to 5.00 mass %

The element Mo is a ferrite stabilizing element and is excellent in advantageously elevating the $\alpha \rightarrow \gamma$ transformation temperature. However, when it is contained less than the lower limit value, the advantage thereof becomes insufficient. Furthermore, when its amount exceeds the upper limit value, the ductility of steel is lowered to result in deteriorating the shock-resistance. The upper limit value of Mo is preferably set at 3.00 mass % and more preferably at 1.00 mass %.

According to a preferred embodiment, the minimum amount of Mo present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

S: 0.01 to 0.50 mass %

The element S forms Mn-based sulfide and thereby improves the machinability. When it is present in an amount less than the lower limit value, the advantage thereof becomes insufficient. The lower limit value of S is preferably set at 0.03 mass %. Furthermore, when its amount exceeds the upper limit value, the ductility, the oxidation resistance and the thermal fatigue resistance are lowered. The upper limit value of S is preferably set at 0.10 mass %.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

N: 0.01 to 0.15 mass %

The element N improves the high temperature strength. However, when it is contained less than the foregoing lower limit value, the advantage thereof becomes insufficient and when its amount exceeds the upper limit value, the ductility is decreased.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

P: 0.50 mass % or less

The element P decreases the oxidation resistance and the thermal fatigue resistance. Accordingly, the upper limit value is best limited to the foregoing value and more preferably to 0.10 mass % or less.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

B: 0.005 to 0.100 mass %

The element B improves the machinability. Furthermore, B is also effective in reducing carbide size to improve the high-temperature strength and improve the toughness. When B is less than the foregoing lower limit value, the advantage thereof becomes insufficient and when it is present in an amount exceeding the upper limit value, the thermal fatigue resistance is decreased.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Ca: 0.005 to 0.100 mass %

When the element Ca is added, the machinability can be improved. When it is contained less than the upper limit value, the advantage thereof is not sufficiently exerted and, when it is added in an amount exceeding the upper limit value, the thermal fatigue resistance is decreased.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Ta: 0.01 to 1.00 mass %

The element Ta forms stable TaC, thereby elevating the $\alpha \rightarrow \gamma$ transformation temperature and improves the high temperature strength; accordingly, when the usable temperature is further increased, it may be added. At that time, when it is added 0.01 mass % or less, the advantage thereof is not seen; accordingly, the lower limit value is preferably set at 0.01 mass %. However, even if Ta is added in an amount exceeding 1.00 mass %, not only is the advantage thereof lost, but also the ductility is largely decreased; accordingly, the upper limit value is preferably set at 1.00 mass %.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Ti: 0.01 to 1.00 mass %

The element Ti forms stable TiC, thereby elevating the $\alpha \rightarrow \gamma$ transformation temperature and improving the high temperature strength; accordingly, when the usable temperature is increased, it may be added. At that time, when it is added in an amount of 0.01 mass % or less, its advantage is lost; accordingly, the lower limit value is preferably set at 0.01 mass %. However, even if Ti is added in an amount exceeding 1.00 mass %, not only is the advantage thereof lost but also, the ductility is greatly decreased; accordingly, the upper limit value is preferably set at 1.00 mass %.

According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Al: 0.01 to 1.00 mass %

The element Al stabilizes ferrite by elevating the $\alpha \rightarrow \gamma$ transformation temperature and improves the high temperature strength; accordingly, when the usable upper limit for temperature is raised, it may be added. When it is added in an amount of 0.01 mass % or less, the advantage is lost; accordingly, the lower limit value thereof is preferably set at 0.01 mass %. However, even if Al is added in an amount exceeding 1.00 mass %, not only is its advantage lost but also, owing to the reduced fluidity of molten metal, the structural defects tend to result and the ductility is largely decreased; accordingly, the upper limit value is preferably set at 1.00 mass %.

According to a preferred embodiment, the minimum amount of Al present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Zr: 0.01 to 0.20 mass %

The element Zr also stabilizes ferrite by elevating the $\alpha \rightarrow \gamma$ transformation temperature and improves the high temperature strength; accordingly, when the usable upper limit temperature is raised, it may be added. When it is added 0.01 mass % or less, its advantage is lost; accordingly, the lower limit value is preferably set at 0.01 mass %. However, even if Zr is added in an amount exceeding 0.20 mass %, not only is its advantage lost but also the ductility is greatly decreased; accordingly, the upper limit value is preferably set at 0.20 mass %.

According to a preferred embodiment, the minimum amount of Zr present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

One of Sc, Y, La, Ce, Pr, Nd, Sm, Eu, Gd, Tb, Dy, Ho, Er, Tm, Yb and Lu, or two or more thereof in total: 0.005 to 0.100 mass %

When the rare earth elements are added, the oxidation resistance can be improved. However, when the total added amount thereof is less than the foregoing lower limit value, the advantage thereof becomes insufficient and, when it exceeds the upper limit value, the thermal fatigue resistance is lowered.

According to a preferred embodiment, the minimum amount of rare earths present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

Allowable ranges that make possible the advantages of the invention are as follows (because of impracticality, rare gas elements, artificial elements and radioactive elements are omitted).

H, Li, Na, K, Rb, Cs, 0.01 mass % or less, respectively,
Be, Mg, Sr, Ba: 0.01 mass % or less, respectively
Hf: 0.1 mass % or less, respectively
Re: 0.01 mass % or less, respectively
Ru, Os: 0.01 mass % or less, respectively
Rh, Pd, Ag, Ir, Pt, Au: 0.01 mass % or less, respectively
Zn, Cd: 0.01 mass % or less, respectively
Ga, In, TI: 0.01 mass % or less, respectively
Ge, Sn, Pb: 0.1 mass % or less, respectively
As, Sb, Bi, Te: 0.01 mass % or less, respectively
O: 0.02 mass % or less
Se, Te, 0.1 mass % or less, respectively
F, Cl, Br, 1, 0.01 mass % or less, respectively According to a preferred embodiment, the minimum amount present in the cast steel is at least 1/10 of the smallest non-zero amount used in the examples of the developed cast steels as summarized in Tables 1 to 3. According to a further embodiment, the minimum amount present in the cast steel is the smallest non-zero amount used in the examples of the developed cast steels as summarized in Tables 1 to 3. According to a further embodiment, the maximum amount present in the cast steel is 1.1 times the highest amount used in the examples of the developed cast steels as summarized in Tables 1 to 3. According to a further embodiment, the maximum amount present in the cast steel is the maximum amount used in the examples of the developed cast steels as summarized in Tables 1 to 3.

In a process for producing a cast part of the invention, a melt of the ferritic stainless steel cast iron of the invention is cast into a sand mold in the shape of the part by the low-pressure casting method. In the ferritic stainless steel cast iron that is used in the invention, the oxidation resistance at high temperatures is heightened due to a higher content of Cr, and, furthermore, the melting point of steel is appropriately lowered and the fluidity of molten metal appropriate for precision casting of a thin shape can be secured since the balance between C and Si is controlled. A sufficient casting flow can be secured even in a narrow cavity by applying a low-pressure casting method where, by use of a sand mold having gas permeability, the inside of a cavity is depressurized to suck a melt of the ferritic stainless steel cast iron in the cavity to cast is adopted. Accordingly, together with an improvement in the fluidity of molten metal of the ferritic stainless steel cast iron, a cast part can be produced while structural defects such as the sand intrusion and voids are sufficiently suppressed. Thereby, even a cast part having a thin portion having a thickness of 1 to 5 mm such as an exhaust system component of an internal combustion engine can be produced with good quality.

Owing to the adoption of the low-pressure casting method, the cooling efficiency of the molten metal is improved, and, thereby, even in a relatively thick portion (for instance, a portion having a thickness of more than 5 mm and not more than 50 mm), the average grain size of ferrite can be reduced to 100 to 800 μm, and further reduction to 70 to 350 μm can be obtained in a thin portion. Furthermore, the casting segregation can be improved as well. Thereby, the proof strength, the tensile strength and the elongation up to break (resultantly, the toughness and the shock-resistance) at high temperatures of the cast part can all be improved to result in an improvement in the thermal fatigue resistance (in particular, in the thin portion).

Figure 1:
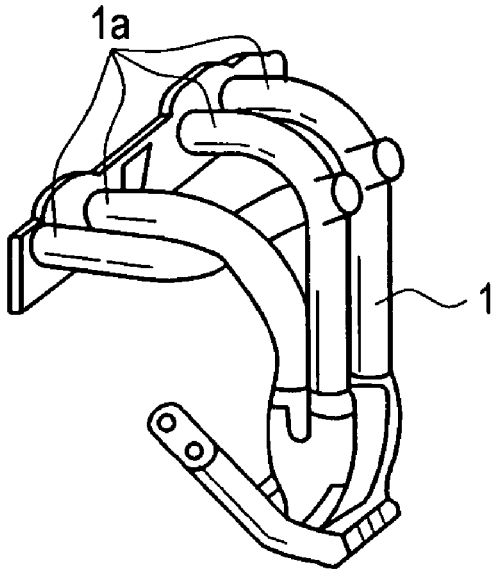
FIG. 1 is a perspective view showing a first example of a thin cast part of the invention.

The reference numerals used in the drawings denote the followings, respectively.

1: Exhaust manifold (thin cast part)
2: Manifold converter (thin cast part)
3: Front pipe (thin cast part)
4: Flexible pipe (thin cast part)
5: Converter shell (thin cast part)
6: Center pipe (thin cast part)
7: Main muffler (thin cast part)
8: Tail end pipe (thin cast part)

DETAILED DESCRIPTION OF THE INVENTION

Figure 2:
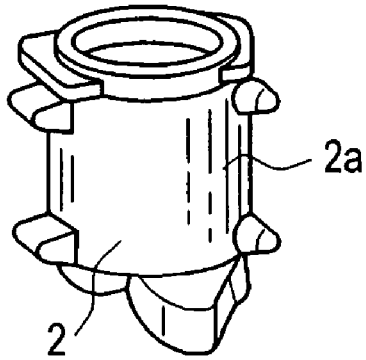
FIG. 2 is a perspective view showing a second example of a thin cast part of the invention.
Figure 3:
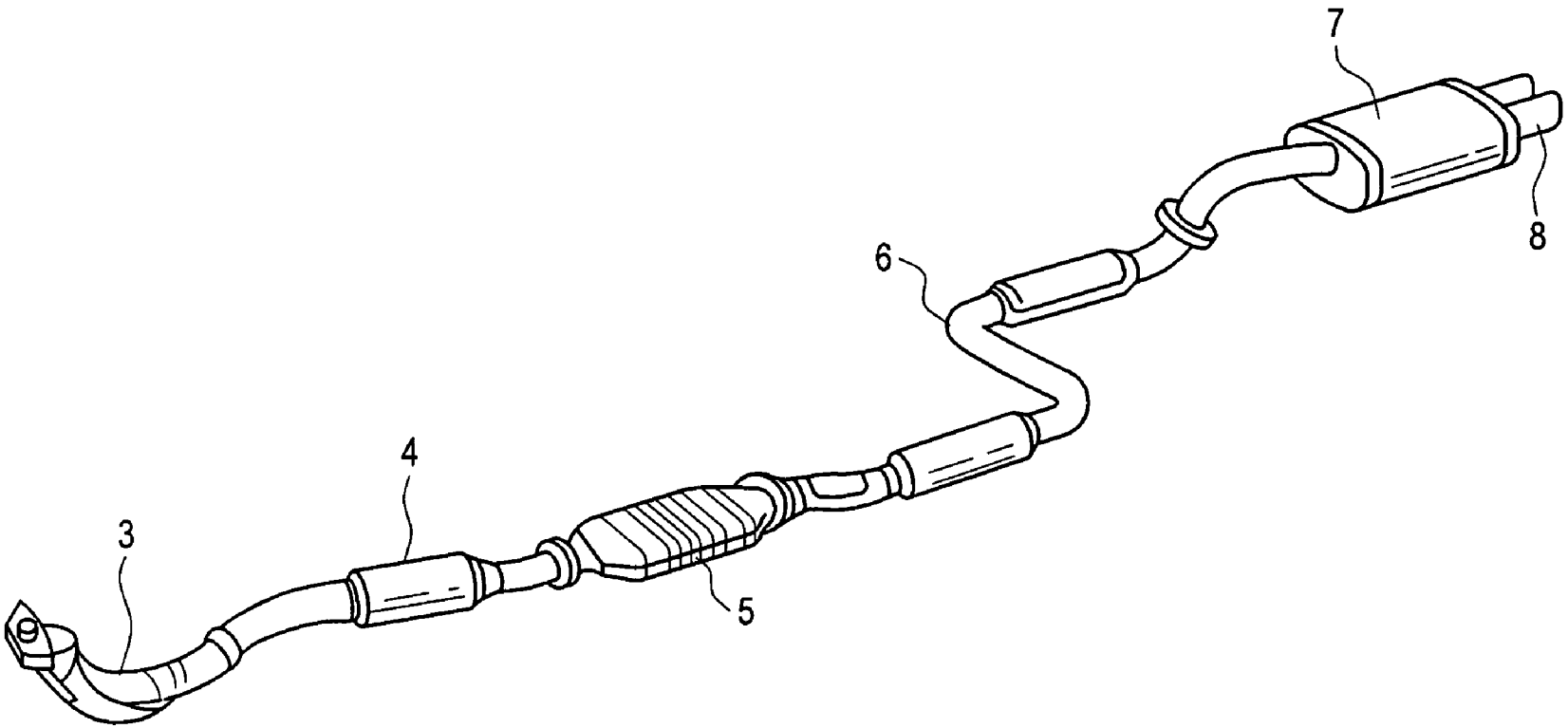
FIG. 3 is a perspective view showing a third example of a thin cast part of the invention.

FIGS. 1 to 3 each shows an example of an exhaust system part that can be configured as a thin cast part of the invention. FIG. 1 shows an exhaust manifold 1, FIG. 2 shows a manifold converter 2. Members shown in FIG. 3 represent a front pipe 3, a flexible pipe 4, a converter shell 5, a center pipe 6, a main muffler 7 and a tale end pipe 8, respectively. In particular, the invention can be effectively applied to an exhaust manifold 1 or a manifold converter 2 on a high temperature side. As to the former one, a branched pipe portion 1*a* from the respective cylinders and as to the latter one a tubular body wall portion 2*a* each are formed into a thin portion.

Figure 7:
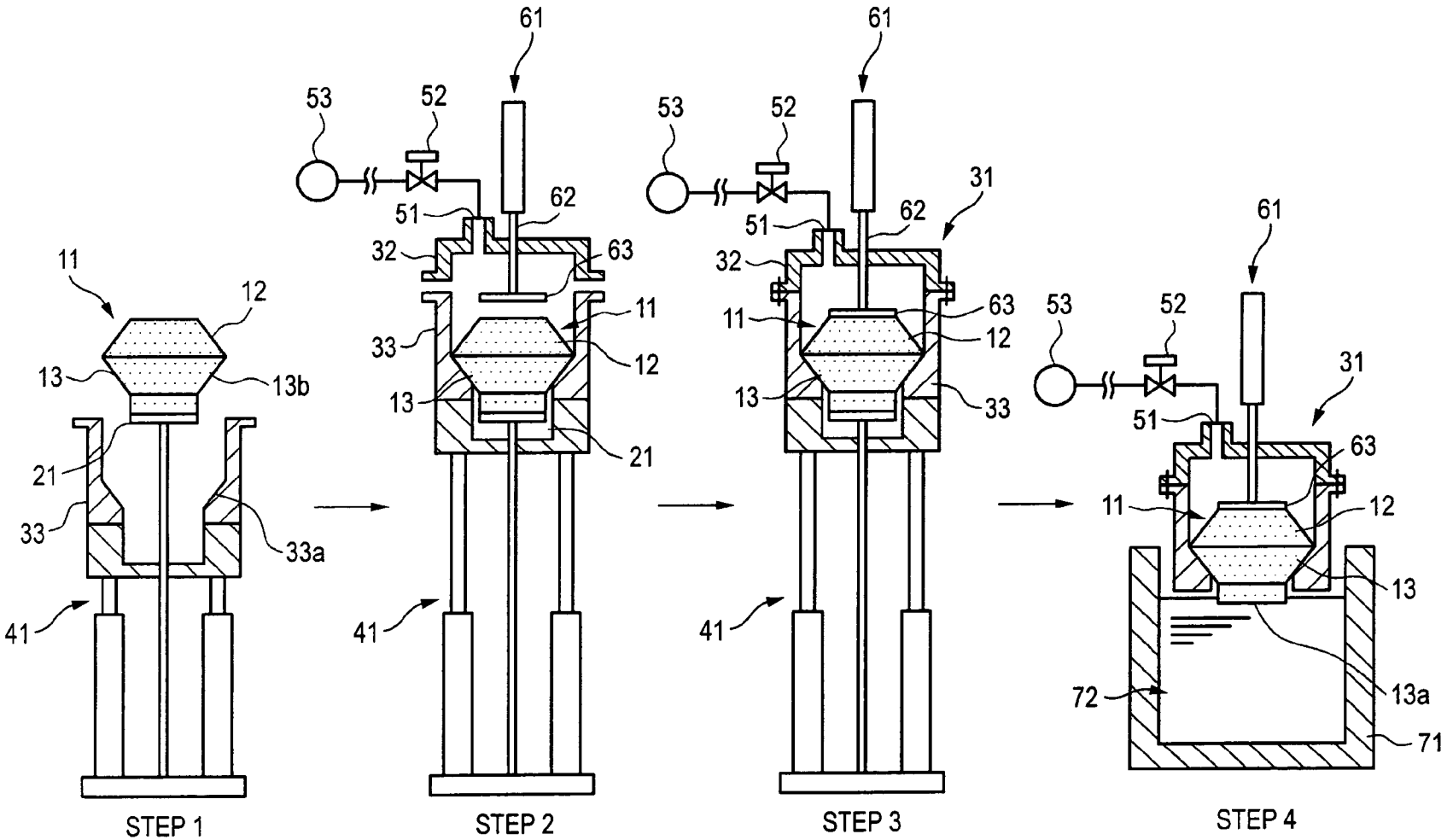
FIG. 7 is a process explanatory diagram showing an example of a low-pressure casting method.

FIG. 7 shows an example of a method of implementing a low-pressure casting method. A cast mold 11 is provided with an upper mold 12 and a lower mold 13 both made of a sand mold, and the upper mold 12 is joined on the lower mold 13 to form a cavity corresponding to a part shape to be produced. Specifically, the cast mold 11 is transported by use of a not shown transporting unit and placed on a mounting table 21. A chamber 31 is divided into two chambers of an upper chamber 32 and a lower chamber 33, around the mounting table 21 the lower chamber 33 is disposed, and the lower chamber 33 is placed on an elevator 41. An outer peripheral surface of the lower mold 13 is formed into a tilting surface 13*b* that becomes narrower downwards except the proximity of a molten metal suction port 13*a* and an inner periphery lower portion of the lower chamber 33 is formed into a tilting surface 33*a* that becomes narrower downwards corresponding to the tilting surface 13*b* of the lower mold 13. What is mentioned above is a state of step 1 of FIG. 7.

In a state of step 1 of FIG. 7, the elevator 41 is operated to elevate the lower chamber 33 to bring the tilting surface 33*a* of the lower chamber 33 into contact with the tilting surface 13*b* of the lower mold 13. In the lower mold 13, all outer periphery surface thereof is engaged with the lower chamber 33 except the neighborhood of the molten metal suction port 13*a* to be covered with the lower chamber 33. Immediately above the lower chamber 33, the upper chamber 32 hanged by a not shown suspending unit is disposed. On a top surface of the upper chamber 32, a suction port 51 is opened and the suction port 51 is connected to a vacuum pump 53 through a control valve 52. Furthermore, on a top surface of the upper chamber 32, a cylinder unit 61 is disposed, a cylinder rod 62 of the cylinder unit 61 penetrates through the top surface of the upper chamber 32, and to a lower end thereof a press member 63 is attached. What is mentioned above is a state of step 2 of FIG. 7.

In a state of step 2 in FIG. 7, a not shown suspending unit is operated to lower the upper chamber 32 to place the upper chamber 32 on the lower chamber 33, followed by clamping the upper chamber 32 and the lower chamber 33 at both flange portions with a bolt and nut. The chamber 31 is thus formed, in this state, the cylinder unit 61 is operated to lower the press member 63 through a cylinder rod 62 to bring into contact with the upper mold 12 to press the upper mold 12 against the lower mold 13 to bring into close contact each other and simultaneously press the lower mold 13 against the lower chamber 33 to bring both tilting surfaces 13*b* and 13*a* into close contact each other. Thus, the cast mold 11 is formed from the upper mold 12 and the lower mold 13 and the cast mold 11 is supported through the chamber 31. What is mentioned above is a state of step 3 of FIG. 7.

Figure 4:
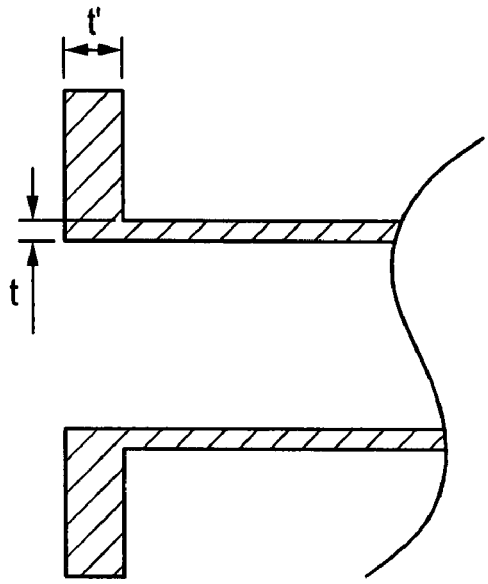
FIG. 4 is a conceptual diagram of a thin portion.

In a state of step 3 in FIG. 7, a not shown suspending unit is operated to elevate and move the chamber 31 that supports the cast mold 11 to immediate above of a molten metal 72 being dissolved in an induction heating furnace 71. Furthermore, the not shown suspending unit is operated to lower the chamber 31 that supports the cast mold 11 to dip the molten metal suction port 13*a* of the lower mold 13 in the molten metal 72. In this state, the vacuum pump 53 is operated to evacuate the inside of the chamber 31 through the control valve 52 and the suction port 51. Since the cast mold 11 is porous, when the chamber 31 is evacuated, through a wall portion of the cast mold, the inside of the cavity is depressurized as well, and thereby the molten metal 72 is suctioned in the cavity. What is mentioned above is a state of step 4 in FIG. 4. After that, according to a standard method of the low-pressure casting method, through cooling, demolding and finishing steps, a cast is obtained. However, before the suction port 13*a* of the lower mold 13 is dipped in the molten metal 72, normally, the neighborhood of the suction port 13*a* of the lower mold 13 that is exposed from the chamber 31 is covered with a sealing material.

EXAMPLES

The present invention is now illustrated in greater detail with reference to Examples and Comparative Examples, but it should be understood that the present invention is not to be construed as being limited thereto.

Experimental Example 1

Figure 5:
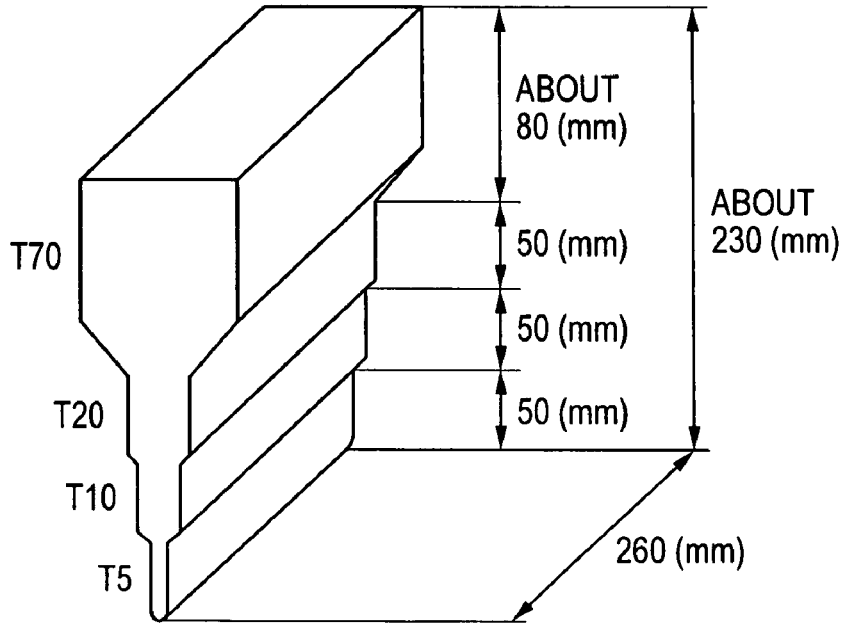
FIG. 5 is a perspective view showing an ingot sample having a thin portion.

Raw materials were blended so as to obtain alloy compositions shown in Tables 1 to 5, followed by melting in a 150 kg high frequency induction furnace, further followed by casting into a shape of FIG. 5 by means of the low-pressure casting method (average reduced pressure gradient: $1\times10^{-2}$ Pa/sec). An ingot sample had a length of 260 mm, weight of substantially 14 kg and a thin portion having a thickness of 5 mm at a tip portion. That the cooling speed of the molten metal in the thin portion (average value up to 800° C.) is 20° C./min or more was previously confirmed by means of simulation. After that, the cast mold was broken down, a cast was taken out, the shot-blasting was applied to remove sand on a surface, followed by applying a heat treatment for homogenizing at 1000° C. for 1 hr, further followed by cooling with air. In the following tables, the sign "–" denotes a content below a detection limit value.

TABLE 1

(mass %)

| | Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|---|
| Invention Example | 1 | 0.26 | 2.84 | 0.3 | 17.5 | 2.5 | — | — | — | — | — | — | — | — | — | — | — | — | — | — | — |
| | 2 | 0.37 | 2.42 | 0.4 | 18.4 | 1.8 | — | — | — | — | — | — | — | — | — | — | — | — | — | — | — |
| | 3 | 0.34 | 2.89 | 0.5 | 17.2 | 1.6 | — | — | — | — | — | — | — | — | — | — | — | — | — | — | — |
| | 4 | 0.26 | 2.78 | 0.5 | 20.9 | 3.8 | — | — | — | — | — | — | — | — | — | — | — | — | — | — | — |
| | 5 | 0.33 | 2.22 | 0.6 | 21.3 | 1.1 | — | — | — | — | — | — | — | — | — | — | — | — | — | — | — |
| | 6 | 0.30 | 2.15 | 0.8 | 16.9 | 1.4 | — | — | — | — | — | — | — | — | — | — | — | — | — | — | — |
| | 7 | 0.43 | 2.12 | 0.4 | 17.4 | 1.6 | — | — | — | — | — | — | — | — | — | — | — | — | — | — | — |
| | 8 | 0.32 | 2.52 | 2.6 | 18.4 | 1.4 | — | — | — | — | — | — | — | — | — | — | — | — | — | — | — |
| | 9 | 0.28 | 1.99 | 0.7 | 23.4 | 1.7 | — | — | — | — | — | — | — | — | — | — | — | — | — | — | — |
| | 10 | 0.35 | 1.78 | 0.6 | 17.6 | 1.5 | 0.49 | — | — | — | — | — | — | — | — | — | — | — | — | — | — |
| | 11 | 0.34 | 1.90 | 0.6 | 18.5 | 1.6 | — | 1.9 | — | — | — | — | — | — | — | — | — | — | — | — | — |
| | 12 | 0.34 | 1.83 | 0.7 | 19.5 | 1.4 | — | 0.8 | — | — | — | — | — | — | — | — | — | — | — | — | — |
| | 13 | 0.31 | 2.38 | 0.4 | 15.3 | 1.7 | — | 0.2 | — | — | — | — | — | — | — | — | — | — | — | — | — |
| | 14 | 0.34 | 3.00 | 0.4 | 19.3 | 1.5 | — | — | 0.4 | — | — | — | — | — | — | — | — | — | — | — | — |
| | 15 | 0.36 | 2.10 | 0.5 | 17.2 | 1.7 | — | — | — | 1.9 | — | — | — | — | — | — | — | — | — | — | — |
| | 16 | 0.27 | 2.42 | 0.8 | 17.2 | 2.2 | — | — | — | 0.2 | — | — | — | — | — | — | — | — | — | — | — |
| | 17 | 0.37 | 2.43 | 0.7 | 18.0 | 1.3 | — | — | — | — | 1.9 | — | — | — | — | — | — | — | — | — | — |
| | 18 | 0.29 | 1.97 | 0.9 | 17.6 | 1.4 | — | — | — | — | 0.1 | — | — | — | — | — | — | — | — | — | — |
| | 19 | 0.35 | 2.34 | 0.5 | 16.7 | 1.5 | — | — | — | — | — | 0.03 | — | — | — | — | — | — | — | — | — |
| | 20 | 0.30 | 2.43 | 0.4 | 16.9 | 1.6 | — | — | — | — | — | — | 0.03 | — | — | — | — | — | — | — | — |
| | 21 | 0.33 | 1.68 | 0.7 | 17.9 | 1.5 | — | 0.5 | — | — | — | — | — | — | — | — | — | — | — | — | — |

TABLE 2

(mass %)

| | Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|---|
| Invention Example | 22 | 0.39 | 2.04 | 0.6 | 17.7 | 1.7 | — | — | — | — | — | — | — | 0.04 | — | — | — | — | — | — | — |
| | 23 | 0.37 | 2.43 | 0.8 | 18.4 | 1.4 | — | — | — | — | — | — | — | — | 0.02 | — | — | — | — | — | — |
| | 24 | 0.35 | 1.89 | 0.7 | 18.3 | 1.8 | — | — | — | — | — | — | — | — | — | 0.02 | — | — | — | — | — |
| | 25 | 0.34 | 2.65 | 0.5 | 17.2 | 1.6 | — | — | — | — | — | — | — | — | — | — | 0.12 | — | — | — | — |
| | 26 | 0.37 | 2.42 | 0.4 | 18.4 | 1.8 | — | — | — | — | — | — | — | — | — | — | — | 0.09 | — | — | — |
| | 27 | 0.32 | 2.35 | 0.8 | 16.9 | 1.7 | — | — | — | — | — | — | — | — | — | — | — | — | 0.13 | — | — |
| | 28 | 0.33 | 2.44 | 0.7 | 17.4 | 1.8 | — | — | — | — | — | — | — | — | — | — | — | — | — | 0.05 | — |
| | 29 | 0.31 | 1.97 | 0.8 | 21.2 | 1.9 | — | — | — | — | — | — | — | — | — | — | — | — | — | — | 0.02 |
| | 30 | 0.37 | 1.98 | 0.6 | 18.3 | 2.7 | 0.49 | — | — | — | — | — | — | — | — | — | — | — | — | — | — |
| | 31 | 0.26 | 2.22 | 0.5 | 17.4 | 1.8 | 0.19 | — | — | — | — | — | — | — | — | — | — | — | — | — | — |
| | 32 | 0.36 | 2.76 | 0.4 | 17.6 | 1.9 | 0.27 | — | — | — | — | — | — | — | — | — | — | — | — | — | — |
| | 33 | 0.33 | 2.54 | 0.4 | 16.9 | 2.5 | 0.45 | — | — | — | — | — | — | — | — | — | — | — | — | — | — |
| | 34 | 0.26 | 2.38 | 0.6 | 21.6 | 1.4 | 0.93 | — | — | — | — | — | — | — | — | — | — | — | — | — | — |
| | 35 | 0.31 | 1.67 | 0.5 | 20.1 | 1.6 | 0.35 | — | — | — | — | — | — | — | — | — | — | — | — | — | — |
| | 36 | 0.30 | 2.01 | 0.7 | 18.8 | 1.1 | 0.51 | — | — | — | — | — | — | — | — | — | — | — | — | — | — |
| | 37 | 0.35 | 2.35 | 0.9 | 17.1 | 1.8 | 0.50 | — | — | — | — | — | — | — | — | — | — | — | — | — | — |
| | 38 | 0.39 | 2.78 | 2.2 | 18.6 | 1.9 | 0.20 | — | — | — | — | — | — | — | — | — | — | — | — | — | — |

TABLE 2-continued (mass %)

| Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|
| 39 | 0.31 | 2.03 | 0.9 | 23.8 | 2.0 | 0.38 | — | — | — | — | — | — | — | — | — | — | — | — | — | — |
| 40 | 0.26 | 1.96 | 0.5 | 16.7 | 2.3 | 0.34 | — | — | — | — | — | — | — | — | — | — | — | — | — | — |
| 41 | 0.28 | 2.01 | 0.5 | 17.9 | 1.5 | 1.68 | — | — | — | — | — | — | — | — | — | — | — | — | — | — |
| 42 | 0.31 | 2.23 | 0.5 | 18.3 | 1.2 | 0.09 | — | — | — | — | — | — | — | — | — | — | — | — | — | — |

TABLE 3

(mass %)

| | Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|---|
| Invention Example | 43 | 0.36 | 1.91 | 0.6 | 17.2 | 1.9 | 0.20 | 2.1 | — | — | — | — | — | — | — | — | — | — | — | — | — |
| | 44 | 0.38 | 1.83 | 0.5 | 18.3 | 1.8 | 0.30 | 0.9 | — | — | — | — | — | — | — | — | — | — | — | — | — |
| | 45 | 0.30 | 1.93 | 0.6 | 15.9 | 1.3 | 0.31 | 0.1 | — | — | — | — | — | — | — | — | — | — | — | — | — |
| | 46 | 0.30 | 2.99 | 0.7 | 18.9 | 1.6 | 0.24 | — | 0.5 | — | — | — | — | — | — | — | — | — | — | — | — |
| | 47 | 0.33 | 2.87 | 0.7 | 18.5 | 2.1 | 0.40 | — | — | 2.0 | — | — | — | — | — | — | — | — | — | — | — |
| | 48 | 0.37 | 2.19 | 0.8 | 16.9 | 1.9 | 0.36 | — | — | 0.1 | — | — | — | — | — | — | — | — | — | — | — |
| | 49 | 0.36 | 2.29 | 0.8 | 17.9 | 1.3 | 0.50 | — | — | — | 2.3 | — | — | — | — | — | — | — | — | — | — |
| | 50 | 0.32 | 1.89 | 0.9 | 17.9 | 1.7 | 0.54 | — | — | — | 0.2 | — | — | — | — | — | — | — | — | — | — |
| | 51 | 0.32 | 2.17 | 0.9 | 17.2 | 2.0 | 0.51 | — | — | — | — | 0.04 | — | — | — | — | — | — | — | — | — |
| | 52 | 0.31 | 2.38 | 0.9 | 17.1 | 2.1 | 0.35 | — | — | — | — | — | 0.04 | — | — | — | — | — | — | — | — |
| | 53 | 0.28 | 2.12 | 0.5 | 19.0 | 1.3 | 0.63 | — | — | — | — | — | — | 0.06 | — | — | — | — | — | — | — |
| | 54 | 0.29 | 2.39 | 0.6 | 18.5 | 1.2 | 0.26 | — | — | — | — | — | — | — | 0.03 | — | — | — | — | — | — |
| | 55 | 0.35 | 1.89 | 0.7 | 18.1 | 1.8 | 0.30 | — | — | — | — | — | — | — | — | 0.02 | — | — | — | — | — |
| | 56 | 0.33 | 2.58 | 0.4 | 18.2 | 1.7 | 0.22 | — | — | — | — | — | — | — | — | — | 0.13 | — | — | — | — |
| | 57 | 0.38 | 2.37 | 0.6 | 19.1 | 1.3 | 0.28 | — | — | — | — | — | — | — | — | — | — | 0.10 | — | — | — |
| | 58 | 0.31 | 1.91 | 0.7 | 16.5 | 1.4 | 0.37 | — | — | — | — | — | — | — | — | — | — | — | 0.10 | — | — |
| | 59 | 0.30 | 1.78 | 0.9 | 17.8 | 1.9 | 0.29 | — | — | — | — | — | — | — | — | — | — | — | — | 0.02 | — |
| | 60 | 0.38 | 1.57 | 0.5 | 19.5 | 1.9 | 0.40 | — | — | — | — | — | — | — | — | — | — | — | — | — | 0.03 |
| | 61 | 0.31 | 1.78 | 0.6 | 17.2 | 1.4 | 0.12 | 0.6 | — | — | — | — | — | — | — | — | — | — | — | — | — |

TABLE 4

(mass %)

| | Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|---|
| Comparative Example | 62 | 0.75 | 3.25 | 0.6 | 15.6 | 1.8 | — | — | — | — | — | — | — | — | — | — | — | — | — | — | — |
| | 63 | 0.05 | 3.01 | 0.5 | 16.3 | 1.7 | — | — | — | — | — | — | — | — | — | — | — | — | — | — | — |
| | 64 | 0.31 | 5.43 | 0.5 | 16.0 | 1.5 | — | — | — | — | — | — | — | — | — | — | — | — | — | — | — |
| | 65 | 0.23 | 0.12 | 0.5 | 17.5 | 1.6 | — | — | — | — | — | — | — | — | — | — | — | — | — | — | — |
| | 66 | 0.24 | 2.68 | 3.2 | 18.3 | 1.4 | — | — | — | — | — | — | — | — | — | — | — | — | — | — | — |
| | 67 | 0.35 | 2.34 | 0.3 | 33.2 | 1.7 | — | — | — | — | — | — | — | — | — | — | — | — | — | — | — |
| | 68 | 0.31 | 3.11 | 0.4 | 5.1 | 1.6 | — | — | — | — | — | — | — | — | — | — | — | — | — | — | — |
| | 69 | 0.21 | 3.07 | 0.5 | 18.8 | 5.4 | — | — | — | — | — | — | — | — | — | — | — | — | — | — | — |
| | 70 | 0.22 | 1.99 | 0.8 | 17.0 | 0.3 | — | — | — | — | — | — | — | — | — | — | — | — | — | — | — |
| | 71 | 0.25 | 2.23 | 0.7 | 17.1 | 2.1 | 3.50 | — | — | — | — | — | — | — | — | — | — | — | — | — | — |
| | 72 | 0.31 | 1.86 | 0.4 | 15.4 | 1.9 | — | 5.5 | — | — | — | — | — | — | — | — | — | — | — | — | — |
| | 73 | 0.30 | 2.52 | 0.5 | 16.7 | 1.9 | — | — | 2.6 | — | — | — | — | — | — | — | — | — | — | — | — |
| | 74 | 0.30 | 2.41 | 0.8 | 18.8 | 1.7 | — | — | — | 5.1 | — | — | — | — | — | — | — | — | — | — | — |
| | 75 | 0.21 | 3.19 | 0.3 | 15.7 | 1.8 | — | — | — | — | — | 0.61 | — | — | — | — | — | — | — | — | — |
| | 76 | 0.30 | 3.10 | 0.4 | 20.1 | 1.7 | — | — | — | — | — | — | 0.53 | — | — | — | — | — | — | — | — |
| | 77 | 0.05 | 0.46 | 0.5 | 19.2 | 1.1 | — | 2.0 | — | — | — | — | — | — | — | — | — | — | — | — | — |
| | 78 | 0.27 | 0.78 | 0.6 | 19.8 | 0.7 | — | — | — | — | — | — | — | — | — | — | — | — | — | — | — |
| | 79 | 0.54 | 2.45 | 0.7 | 17.7 | 1.4 | 0.28 | — | — | — | — | — | — | — | — | — | — | — | — | — | — |

TABLE 5

(mass %)

| | Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|---|
| Comparative Example | 80 | 0.04 | 1.78 | 0.6 | 16.9 | 1.9 | 0.22 | — | — | — | — | — | — | — | — | — | — | — | — | — | — |
| | 81 | 0.33 | 3.35 | 0.6 | 15.8 | 2.2 | 0.29 | — | — | — | — | — | — | — | — | — | — | — | — | — | — |
| | 82 | 0.26 | 0.26 | 0.7 | 17.9 | 1.2 | 0.39 | — | — | — | — | — | — | — | — | — | — | — | — | — | — |
| | 83 | 0.28 | 2.38 | 3.7 | 19.9 | 1.1 | 0.29 | — | — | — | — | — | — | — | — | — | — | — | — | — | — |
| | 84 | 0.36 | 2.49 | 0.7 | 32.7 | 1.4 | 0.64 | — | — | — | — | — | — | — | — | — | — | — | — | — | — |
| | 85 | 0.30 | 2.89 | 0.6 | 9.1 | 2.6 | 0.37 | — | — | — | — | — | — | — | — | — | — | — | — | — | — |
| | 86 | 0.27 | 1.85 | 0.3 | 19.2 | 5.2 | 0.45 | — | — | — | — | — | — | — | — | — | — | — | — | — | — |
| | 87 | 0.28 | 1.91 | 0.6 | 17.3 | 1.2 | 0.42 | — | — | — | — | — | — | — | — | — | — | — | — | — | — |

TABLE 5-continued

| Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|
| | | | | | | | | | | | | | | | | | | | | (mass %) |
| 88 | 0.25 | 2.48 | 0.9 | 18.8 | 2.5 | 4.20 | — | — | — | — | — | — | — | — | — | — | — | — | — | — |
| 89 | 0.34 | 1.92 | 0.5 | 19.2 | 2.0 | 0.14 | 5.1 | — | — | — | — | — | — | — | — | — | — | — | — | — |
| 90 | 0.33 | 2.46 | 0.6 | 15.4 | 1.5 | 0.29 | — | 2.6 | — | — | — | — | — | — | — | — | — | — | — | — |
| 91 | 0.31 | 2.50 | 0.6 | 17.8 | 1.3 | 0.24 | — | — | 5.1 | — | — | — | — | — | — | — | — | — | — | — |
| 92 | 0.29 | 2.89 | 0.6 | 18.2 | 1.9 | 0.23 | — | — | — | — | 0.61 | — | — | — | — | — | — | — | — | — |
| 93 | 0.26 | 2.77 | 0.8 | 17.9 | 2.0 | 0.46 | — | — | — | — | — | 0.53 | — | — | — | — | — | — | — | — |

As to obtained ingot samples, whether or not there is a remarkable casting defect that disturbs to sample a test piece was investigated as evaluation of the casting properties. One having such a defect is evaluated as [×] and one not having such a defect is evaluated as [□]. Of ones evaluated as [□], the number of occurrence of casting defects having a diameter of 1 mm or more was further specified by use of X-ray CT (results are shown adjacent to [□] with the number showing the confirmed occurrence number).

Furthermore, the melting point of an alloy was measured by differential thermal analysis (DTA: temperature-up speed 10° C./min). A formation phase in a structure was determined by X-ray diffractometry. Of all samples, a thin portion was cut in parallel with a thickness direction, a section was polished and observed of the structure, and thereby it was confirmed that the structure has a typical equiaxial structure. In the section, profile lines of the respective grains were specified by well-known image analysis, grain sizes of the respective grains were measured in terms of a diameter of a circle, followed by averaging the values to obtain an average grain size.

Furthermore, from the thin portion of the ingot sample, a test specimen having a distance between scales of 60 mm, a thickness of a parallel portion of 3 mm and a width of 12.5 mm was cut out. The test specimen was subjected to high temperature tensile strength test at setting temperatures of 900° C. and 1000° C., and, from the stress-strain curve, the 0.2% proof strength, the tensile strength and the elongation were read. On the other hand, from the thin portion of the ingot sample, a disc test piece having an outer diameter of 18 mm, an edge angle of 300 and a thickness of 3 mm was cut out, followed by evaluating the thermal fatigue resistance by a method stipulated in JIS: Z2278. Specifically, the disc test piece was dipped in a high temperature fluidizing layer at 900° C. for 3 min, followed by repeating 1000 times a cycle of dipping in a low temperature fluidizing layer at 150° C. for 4 min. After that, a sum total of lengths of cracks generated at a periphery portion of the test specimen was investigated and a variation of the thickness of the test specimen was measured.

Furthermore, as to the machinability, a test specimen having a flange shape and three protrusions in a circumferential direction at a separation of 120° was separately cast. And, each test specimen was subjected to turning with a hard metal tool (JIS: B4503, P30, (Ti, Al)N covered product), under conditions below:

Turning speed: 120 m/min

Tool feed per revolution: 0.3 mm/revolution

Cutting depth: 2.5 mm

Machinability/Tool life: Cutting length when the maximum flank wear amount generated on a tool becomes 200 μm is evaluated as the tool life.

Furthermore, the sulfuric acid dew corrosion resistance was evaluated in such a manner that a test specimen having a dimension of length 3 mm×width 10 mm×length 40 mm was cut out, the sulfuric acid dip test at a gas-liquid equilibrium state of a sulfuric acid-water system (pressure: 101325 Pa, temperature: 100° C.) was applied at a sulfuric acid concentration of 50 mass % for 6 hr, an amount of corrosion weight loss was measured and a corrosion speed per unit time and unit area was calculated. A target value of the sulfuric acid corrosion speed is 50 mg·cm$^{-2}$ hr$^{-1}$. Above results are shown in Tables 6 to 10.

TABLE 6

| | Sample No. | Casting Property | Melting Point (° C.) | Transformation Temperature (° C.) | Grain Size (μm) | High Temperature Strength (900° C.) Tensile Strength (MPa) | 0.2% Yield Strength (MPa) | Elongation (%) | High Temperature Strength (1000° C.) Tensile Strength (MPa) | 0.2% Yield Strength (MPa) | Elongation (%) | Thermal Fatigue Property (900° C.) Crack Length (mm) | Deformation Amount (mm) | Sulfuric Acid Corrosion Speed (mg·cm$^{-2}$·hr$^{-1}$) | Tool Life (mm) |
|---|---|---|---|---|---|---|---|---|---|---|---|---|---|---|---|
| Invention Example | 1 | ○0 | 1461 | >1050 | 210 | 54 | 38 | 106 | 26 | 22 | 122 | 0 | 0.6 | 72 | 5123 |
| | 2 | ○0 | 1459 | >1050 | 133 | 58 | 40 | 111 | 30 | 24 | 136 | 0 | 0.4 | 69 | 5419 |
| | 3 | ○0 | 1458 | >1050 | 149 | 57 | 40 | 107 | 29 | 23 | 129 | 0 | 0.4 | 72 | 5244 |
| | 4 | ○0 | 1451 | 1012 | 183 | 55 | 39 | 115 | 27 | 22 | 133 | 0 | 0.5 | 75 | 4389 |
| | 5 | ○0 | 1473 | >1050 | 155 | 56 | 40 | 113 | 29 | 23 | 135 | 0 | 0.4 | 60 | 5903 |
| | 6 | ○0 | 1474 | >1050 | 175 | 56 | 39 | 114 | 27 | 22 | 133 | 0 | 0.5 | 73 | 5782 |
| | 7 | ○0 | 1457 | >1050 | 108 | 59 | 41 | 115 | 33 | 25 | 144 | 0 | 0.3 | 72 | 5478 |
| | 8 | ○0 | 1457 | >1050 | 161 | 56 | 39 | 110 | 28 | 23 | 131 | 0 | 0.5 | 69 | 5584 |
| | 9 | ○0 | 1477 | >1050 | 191 | 55 | 39 | 115 | 26 | 22 | 132 | 0 | 0.5 | 54 | 5771 |
| | 10 | ○0 | 1456 | >1050 | 189 | 54 | 38 | 105 | 25 | 21 | 118 | 0 | 0.6 | 48 | 4895 |
| | 11 | ○0 | 1459 | >1050 | 212 | 54 | 37 | 100 | 24 | 21 | 132 | 0 | 0.6 | 81 | 5524 |
| | 12 | ○0 | 1458 | >1050 | 229 | 52 | 36 | 101 | 23 | 20 | 120 | 0 | 0.7 | 78 | 5433 |
| | 13 | ○0 | 1469 | >1050 | 168 | 56 | 39 | 111 | 28 | 23 | 131 | 0 | 0.5 | 78 | 5488 |
| | 14 | ○0 | 1458 | >1050 | 149 | 57 | 40 | 105 | 29 | 23 | 128 | 0 | 0.4 | 66 | 5501 |
| | 15 | ○0 | 1457 | >1050 | 208 | 53 | 37 | 103 | 26 | 22 | 123 | 0 | 0.6 | 65 | 5632 |
| | 16 | ○0 | 1467 | >1050 | 200 | 55 | 39 | 111 | 26 | 22 | 127 | 0 | 0.6 | 72 | 5111 |
| | 17 | ○0 | 1449 | >1050 | 142 | 57 | 38 | 111 | 29 | 23 | 127 | 0 | 0.4 | 69 | 5235 |

TABLE 6-continued

| | Sample No. | Casting Property | Melting Point (° C.) | Transformation Temperature (° C.) | Grain Size (μm) | High Temperature Strength (900° C.) Tensile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Deformation Amount (mm) | Sulfuric Acid Corrosion Speed (mg · cm$^{-2}$ · hr$^{-1}$) | Tool Life (mm) |
|---|---|---|---|---|---|---|---|---|---|---|---|---|---|---|---|
| | 18 | ○0 | 1478 | >1050 | 183 | 55 | 39 | 115 | 27 | 22 | 133 | 0 | 0.5 | 71 | 5877 |
| | 19 | ○0 | 1465 | >1050 | 143 | 57 | 40 | 112 | 29 | 23 | 135 | 0 | 0.4 | 74 | 5483 |
| | 20 | ○0 | 1470 | >1050 | 175 | 56 | 39 | 111 | 27 | 22 | 130 | 0 | 0.5 | 73 | 5832 |
| | 21 | ○0 | 1462 | >1050 | 202 | 57 | 40 | 109 | 29 | 23 | 132 | 0 | 0.5 | 69 | 5823 |

TABLE 7

| | Sample No. | Casting Property | Melting Point (° C.) | Transformation Temperature (° C.) | Grain Size (μm) | High Temperature Strength (900° C.) Tensile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Deformation Amount (mm) | Sulfuric Acid Corrosion Speed (mg · cm$^{-2}$ · hr$^{-1}$) | Tool Life (mm) |
|---|---|---|---|---|---|---|---|---|---|---|---|---|---|---|---|
| Invention Example | 22 | ○0 | 1465 | >1050 | 233 | 54 | 39 | 121 | 24 | 20 | 131 | 0 | 0.6 | 68 | 5672 |
| | 23 | ○0 | 1461 | >1050 | 133 | 58 | 40 | 111 | 30 | 24 | 136 | 0 | 0.4 | 69 | 5392 |
| | 24 | ○0 | 1449 | >1050 | 140 | 56 | 39 | 106 | 28 | 22 | 132 | 0 | 0.4 | 68 | 5189 |
| | 25 | ○0 | 1461 | >1050 | 149 | 57 | 40 | 109 | 29 | 23 | 131 | 0 | 0.4 | 72 | 5380 |
| | 26 | ○0 | 1459 | >1050 | 133 | 58 | 40 | 111 | 30 | 24 | 136 | 0 | 0.4 | 69 | 5645 |
| | 27 | ○0 | 1466 | >1050 | 161 | 56 | 39 | 112 | 28 | 23 | 132 | 0 | 0.5 | 73 | 5132 |
| | 28 | ○0 | 1463 | >1050 | 155 | 56 | 40 | 111 | 29 | 23 | 132 | 0 | 0.4 | 72 | 5256 |
| | 29 | ○0 | 1450 | >1050 | 166 | 55 | 39 | 113 | 27 | 22 | 119 | 0 | 0.5 | 71 | 5442 |
| | 30 | ○0 | 1452 | >1050 | 215 | 53 | 37 | 102 | 25 | 21 | 121 | 0 | 0.7 | 13 | 4827 |
| | 31 | ○0 | 1454 | >1050 | 138 | 57 | 39 | 107 | 29 | 23 | 135 | 0 | 0.4 | 45 | 5412 |
| | 32 | ○0 | 1452 | >1050 | 154 | 56 | 39 | 103 | 28 | 22 | 128 | 0 | 0.5 | 37 | 5425 |
| | 33 | ○0 | 1442 | 1005 | 188 | 54 | 38 | 111 | 26 | 21 | 132 | 0 | 0.6 | 16 | 4378 |
| | 34 | ○0 | 1458 | >1050 | 160 | 55 | 39 | 109 | 28 | 22 | 134 | 0 | 0.5 | 12 | 5906 |
| | 35 | ○0 | 1466 | >1050 | 180 | 55 | 38 | 110 | 26 | 21 | 132 | 0 | 0.6 | 26 | 5889 |
| | 36 | ○0 | 1448 | >1050 | 113 | 58 | 40 | 111 | 32 | 24 | 143 | 0 | 0.3 | 13 | 5412 |
| | 37 | ○1 | 1472 | >1050 | 173 | 55 | 38 | 116 | 27 | 22 | 139 | 0 | 0.6 | 11 | 5781 |
| | 38 | ○0 | 1452 | >1050 | 166 | 55 | 38 | 106 | 27 | 22 | 130 | 0 | 0.5 | 45 | 5789 |
| | 39 | ○1 | 1469 | >1050 | 196 | 54 | 38 | 111 | 25 | 21 | 131 | 0 | 0.6 | 15 | 5875 |
| | 40 | ○2 | 1474 | 1001 | 248 | 53 | 37 | 108 | 23 | 20 | 124 | 0 | 0.8 | 48 | 5374 |
| | 41 | ○0 | 1462 | 1007 | 276 | 52 | 37 | 111 | 23 | 19 | 126 | 0 | 0.9 | 12 | 5524 |
| | 42 | ○1 | 1477 | >1050 | 262 | 52 | 37 | 107 | 23 | 20 | 122 | 0 | 0.9 | 48 | 5485 |

TABLE 8

| | Sample No. | Casting Property | Melting Point (° C.) | Transformation Temperature (° C.) | Grain Size (μm) | High Temperature Strength (900° C.) Tensile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Deformation Amount (mm) | Sulfuric Acid Corrosion Speed (mg · cm$^{-2}$ · hr$^{-1}$) | Tool Life (mm) |
|---|---|---|---|---|---|---|---|---|---|---|---|---|---|---|---|
| Invention Example | 43 | ○0 | 1452 | >1050 | 225 | 54 | 36 | 101 | 26 | 22 | 118 | 0 | 0.8 | 47 | 4950 |
| | 44 | ○0 | 1457 | >1050 | 238 | 53 | 36 | 106 | 25 | 20 | 119 | 0 | 0.7 | 48 | 5510 |
| | 45 | ○0 | 1462 | 1039 | 173 | 55 | 38 | 107 | 27 | 22 | 130 | 0 | 0.6 | 43 | 4890 |
| | 46 | ○0 | 1453 | >1050 | 154 | 56 | 39 | 101 | 28 | 22 | 127 | 0 | 0.5 | 43 | 5289 |
| | 47 | ○0 | 1442 | >1050 | 206 | 53 | 37 | 109 | 24 | 20 | 117 | 0 | 0.7 | 19 | 4927 |
| | 48 | ○0 | 1459 | >1050 | 205 | 54 | 38 | 107 | 25 | 21 | 126 | 0 | 0.7 | 25 | 5432 |
| | 49 | ○0 | 1449 | >1050 | 158 | 53 | 39 | 100 | 25 | 21 | 120 | 0 | 0.4 | 33 | 5447 |
| | 50 | ○0 | 1468 | >1050 | 188 | 54 | 38 | 111 | 26 | 21 | 132 | 0 | 0.6 | 12 | 5894 |
| | 51 | ○0 | 1456 | >1050 | 148 | 56 | 39 | 108 | 28 | 22 | 134 | 0 | 0.5 | 15 | 5732 |
| | 52 | ○0 | 1464 | >1050 | 180 | 55 | 38 | 107 | 26 | 21 | 129 | 0 | 0.6 | 38 | 5638 |
| | 53 | ○1 | 1476 | >1050 | 262 | 52 | 37 | 110 | 23 | 20 | 126 | 0 | 0.9 | 11 | 5782 |
| | 54 | ○0 | 1455 | >1050 | 138 | 57 | 39 | 107 | 29 | 23 | 135 | 0 | 0.4 | 33 | 5577 |
| | 55 | ○0 | 1446 | >1050 | 149 | 56 | 38 | 98 | 23 | 22 | 119 | 0 | 0.4 | 23 | 5167 |
| | 56 | ○0 | 1455 | >1050 | 154 | 56 | 39 | 105 | 28 | 22 | 130 | 0 | 0.5 | 37 | 5286 |
| | 57 | ○1 | 1453 | >1050 | 138 | 57 | 39 | 107 | 29 | 23 | 135 | 0 | 0.4 | 33 | 5489 |
| | 58 | ○0 | 1458 | >1050 | 166 | 55 | 38 | 108 | 27 | 22 | 131 | 0 | 0.5 | 26 | 5678 |
| | 59 | ○0 | 1456 | >1050 | 160 | 55 | 39 | 107 | 28 | 22 | 131 | 0 | 0.5 | 36 | 5486 |

TABLE 8-continued

| Sample No. | Casting Property | Melting Point (° C.) | Transformation Temperature (° C.) | Grain Size (μm) | High Temperature Strength (900° C.) Tensile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Deformation Amount (mm) | Sulfuric Acid Corrosion Speed (mg · cm$^{-2}$ · hr$^{-1}$) | Tool Life (mm) |
|---|---|---|---|---|---|---|---|---|---|---|---|---|---|---|
| 60 | ○0 | 1446 | >1050 | 174 | 55 | 37 | 110 | 27 | 22 | 122 | 0 | 0.6 | 14 | 5099 |
| 61 | ○0 | 1451 | >1050 | 188 | 55 | 38 | 106 | 27 | 22 | 129 | 0 | 0.6 | 44 | 5176 |

TABLE 9

| | Sample No. | Casting Property | Melting Point (° C.) | Transformation Temperature (° C.) | Grain Size (μm) | High Temperature Strength (900° C.) Tensile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Deformation Amount (mm) | Sulfuric Acid Corrosion Speed (mg · cm$^{-2}$ · hr$^{-1}$) | Tool Life (mm) |
|---|---|---|---|---|---|---|---|---|---|---|---|---|---|---|---|
| Comparative Example | 62 | x | 1323 | 797 | 453 | — | — | — | — | — | — | — | — | — | — |
| | 63 | ○3 | 1494 | >1050 | 1340 | 24 | 15 | 93 | 11 | 5 | 112 | 22.4 | 0.1 | 121 | 734 |
| | 64 | x | 1428 | >1050 | 418 | — | — | — | — | — | — | — | — | — | — |
| | 65 | ○2 | 1512 | 873 | 493 | 38 | 21 | 54 | 24 | 18 | 62 | 35.6 | 0.1 | 120 | 126 |
| | 66 | x | 1463 | 893 | 481 | — | — | — | — | — | — | — | — | — | — |
| | 67 | ○0 | 1464 | >1050 | 393 | 57 | 40 | 102 | 29 | 20 | 145 | 22.4 | 0.1 | 104 | 5498 |
| | 68 | ○0 | 1460 | 767 | 418 | 23 | 12 | 94 | 12 | 6 | 134 | 0.1 | 1.0 | 89 | 335 |
| | 69 | ○1 | 1435 | >1050 | 521 | 53 | 38 | 94 | 24 | 17 | 105 | 17.7 | 0.1 | 118 | 2512 |
| | 70 | ○1 | 1498 | 803 | 507 | 53 | 38 | 104 | 24 | 18 | 117 | 0.4 | 0.8 | 120 | 6599 |
| | 71 | ○1 | 1421 | 766 | 470 | 54 | 38 | 102 | 25 | 18 | 117 | 6.7 | 1.3 | 6 | 5233 |
| | 72 | ○0 | 1474 | >1050 | 418 | 56 | 39 | 107 | 28 | 20 | 126 | 9.2 | 0.1 | 122 | 1997 |
| | 73 | ○0 | 1466 | 789 | 425 | 56 | 39 | 100 | 27 | 19 | 119 | 0.5 | 0.8 | 120 | 5411 |
| | 74 | ○0 | 1468 | >1050 | 425 | 56 | 39 | 101 | 27 | 19 | 120 | 9.5 | 0.1 | 118 | 1809 |
| | 75 | ○0 | 1470 | >1050 | 521 | 29 | 19 | 23 | 17 | 9 | 31 | 7.7 | 0.1 | 121 | 4995 |
| | 76 | ○0 | 1460 | >1050 | 425 | 28 | 18 | 36 | 19 | 8 | 39 | 7.3 | 0.1 | 117 | 81134 |
| | 77 | ○0 | 1490 | >1050 | 1340 | 37 | 22 | 89 | 22 | 12 | 108 | 0.5 | 0.1 | 118 | 1009 |
| | 78 | ○0 | 1320 | γ-stabilized | 1254 | 103 | 63 | 40 | 80 | 50 | 42 | 2.3 | 0.6 | 117 | 436 |
| | 79 | x | 1321 | 735 | 512 | — | — | — | — | — | — | — | — | — | — |

TABLE 10

| | Sample No. | Casting Property | Melting Point (° C.) | Transformation Temperature (° C.) | Grain Size (μm) | High Temperature Strength (900° C.) Tensile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Deformation Amount (mm) | Sulfuric Acid Corrosion Speed (mg · cm$^{-2}$ · hr$^{-1}$) | Tool Life (mm) |
|---|---|---|---|---|---|---|---|---|---|---|---|---|---|---|---|
| Comparative Example | 80 | ○2 | 1492 | >1050 | 1182 | 23 | 16 | 101 | 12 | 6 | 107 | 28.2 | 0.2 | 87 | 893 |
| | 81 | x | 1426 | >1050 | 423 | — | — | — | — | — | — | — | — | — | — |
| | 82 | ○1 | 1510 | 870 | 489 | 37 | 22 | 62 | 23 | 16 | 59 | 37.1 | 0.4 | 101 | 212 |
| | 83 | x | 1461 | 888 | 389 | — | — | — | — | — | — | — | — | — | — |
| | 84 | ○0 | 1462 | >1050 | 387 | 56 | 41 | 99 | 27 | 18 | 138 | 19.9 | 0.1 | 93 | 5782 |
| | 85 | ○0 | 1458 | 764 | 431 | 34 | 13 | 89 | 13 | 7 | 129 | 0.2 | 1.4 | 67 | 423 |
| | 86 | ○1 | 1433 | >1050 | 517 | 51 | 39 | 87 | 25 | 16 | 116 | 16.8 | 0.1 | 98 | 3108 |
| | 87 | ○1 | 1496 | 798 | 501 | 54 | 37 | 89 | 24 | 17 | 128 | 0.3 | 0.9 | 102 | 6722 |
| | 88 | ○1 | 1419 | 759 | 489 | 55 | 37 | 87 | 26 | 18 | 122 | 7.5 | 1.1 | 5 | 5333 |
| | 89 | ○0 | 1472 | >1050 | 438 | 52 | 38 | 92 | 26 | 19 | 117 | 10.2 | 0.2 | 99 | 1894 |
| | 90 | ○0 | 1464 | 773 | 445 | 48 | 37 | 108 | 27 | 18 | 110 | 0.6 | 1.0 | 78 | 51323 |
| | 91 | ○0 | 1466 | >1050 | 456 | 55 | 38 | 103 | 26 | 18 | 106 | 10.1 | 0.2 | 86 | 2238 |
| | 92 | ○0 | 1468 | >1050 | 512 | 27 | 18 | 33 | 18 | 10 | 32 | 6.6 | 0.2 | 94 | 5183 |
| | 93 | ○0 | 1458 | >1050 | 433 | 27 | 17 | 42 | 20 | 10 | 41 | 8.7 | 0.2 | 78 | 101234 |

According to the above-mentioned results, when ferritic stainless steel cast irons of the invention are used, healthy thin portions can be formed and an average grain size can be controlled to a range of 50 to 400 μm by use of the low-pressure casting method. Furthermore, these are found to be excellent in the high temperature strength and the high temperature fatigue characteristics. Still furthermore, in a composition where an appropriate amount of Cu is added, the sulfuric acid dew corrosion resistance is found remarkably improved.

When the low-pressure casting method is applied, a thin portion can be readily formed into a thickness of less than 5 mm (for instance, 2 to 4 mm). In this case, although the cooling speed is further sped up, an obtained average grain size is substantially same as that of the case of a thickness of 5 mm or improved up to substantially 30% at most.

Experimental Example 2

Among alloy compositions shown in Tables 1 to 3, the samples having alloy compositions as shown in Table 11 below were picked up, and the evaluation results corresponding to these samples were extracted from Tables 6 to 8 to be arranged in Table 12. Incidentally, these samples were prepared by cast-forming each molten metal by the low-pressure casting method to be the shape shown in FIG. 5, which has a thin portion.

Figure 6:
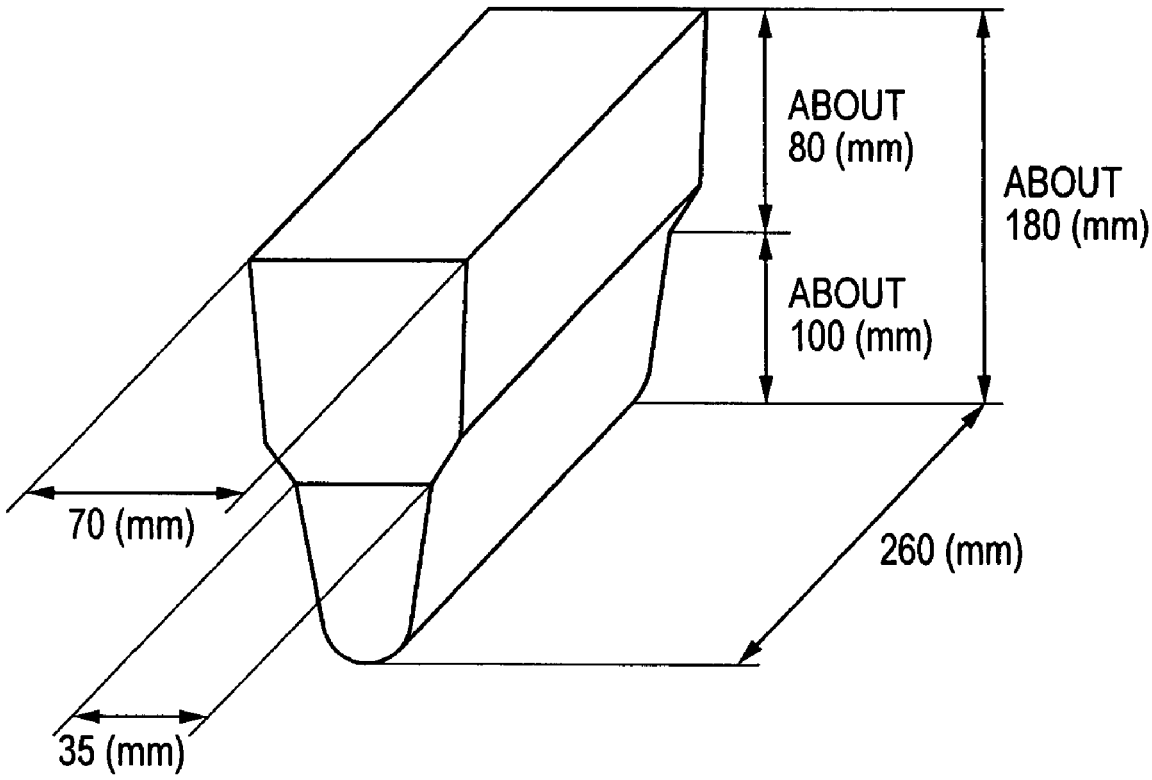
FIG. 6 is a perspective view showing an ingot sample not having a thin portion.

Besides, as comparative examples, samples each having the same composition as the picked up samples mentioned above were cast by means of an ordinary top pouring method under unreduced pressure into a JIS A-shaped ingot sample that is shown in FIG. 6, which does not have a thin portion. The same evaluations as Experimental Example 1 were carried out on thus obtained casts, and the evaluation results thereof were shown in Table 13. The cooling speed obtained by simulation in this case was 16° C./min on a surface at a tip of the ingot and 15° C./min at a center portion in a thickness direction.

TABLE 11

(mass %)

| | Sample No. | C | Si | Mn | Cr | Nb + V | Cu | W | Ni | Mo | Co | P | S | N | B | Ca | Ta | Ti | Al | Zr | REM |
|---|---|---|---|---|---|---|---|---|---|---|---|---|---|---|---|---|---|---|---|---|---|
| Invention Example | 2 | 0.37 | 2.42 | 0.4 | 18.4 | 1.8 | — | — | — | — | — | — | — | — | — | — | — | — | — | — | — |
| | 3 | 0.34 | 2.89 | 0.5 | 17.2 | 1.6 | — | — | — | — | — | — | — | — | — | — | — | — | — | — | — |
| | 6 | 0.30 | 2.15 | 0.8 | 16.9 | 1.4 | — | — | — | — | — | — | — | — | — | — | — | — | — | — | — |
| | 10 | 0.35 | 1.78 | 0.6 | 17.6 | 1.5 | 0.49 | — | — | — | — | — | — | — | — | — | — | — | — | — | — |
| | 11 | 0.34 | 1.90 | 0.6 | 18.5 | 1.6 | — | 1.9 | — | — | — | — | — | — | — | — | — | — | — | — | — |
| | 12 | 0.34 | 1.83 | 0.7 | 19.5 | 1.4 | — | 0.8 | — | — | — | — | — | — | — | — | — | — | — | — | — |
| | 13 | 0.31 | 2.38 | 0.4 | 15.3 | 1.7 | — | 0.2 | — | — | — | — | — | — | — | — | — | — | — | — | — |
| | 14 | 0.34 | 3.00 | 0.4 | 19.3 | 1.5 | — | — | 0.4 | — | — | — | — | — | — | — | — | — | — | — | — |
| | 20 | 0.30 | 2.43 | 0.4 | 16.9 | 1.6 | — | — | — | — | — | — | 0.03 | — | — | — | — | — | — | — | — |
| | 30 | 0.37 | 1.98 | 0.6 | 18.3 | 2.7 | 0.49 | — | — | — | — | — | — | — | — | — | — | — | — | — | — |
| | 31 | 0.26 | 2.22 | 0.5 | 17.4 | 1.8 | 0.19 | — | — | — | — | — | — | — | — | — | — | — | — | — | — |
| | 33 | 0.33 | 2.54 | 0.4 | 16.9 | 2.5 | 0.45 | — | — | — | — | — | — | — | — | — | — | — | — | — | — |
| | 37 | 0.35 | 2.35 | 0.9 | 17.1 | 1.8 | 0.50 | — | — | — | — | — | — | — | — | — | — | — | — | — | — |
| | 40 | 0.26 | 1.96 | 0.5 | 16.7 | 2.3 | 0.34 | — | — | — | — | — | — | — | — | — | — | — | — | — | — |
| | 41 | 0.28 | 2.01 | 0.5 | 17.9 | 1.5 | 1.68 | — | — | — | — | — | — | — | — | — | — | — | — | — | — |
| | 43 | 0.36 | 1.91 | 0.6 | 17.2 | 1.9 | 0.20 | 2.1 | — | — | — | — | — | — | — | — | — | — | — | — | — |
| | 44 | 0.38 | 1.83 | 0.5 | 18.3 | 1.8 | 0.30 | 0.9 | — | — | — | — | — | — | — | — | — | — | — | — | — |
| | 45 | 0.30 | 1.93 | 0.6 | 15.9 | 1.3 | 0.31 | 0.1 | — | — | — | — | — | — | — | — | — | — | — | — | — |
| | 46 | 0.30 | 2.99 | 0.7 | 18.9 | 1.6 | 0.24 | — | 0.5 | — | — | — | — | — | — | — | — | — | — | — | — |
| | 52 | 0.31 | 2.38 | 0.9 | 17.1 | 2.1 | 0.35 | — | — | — | — | — | 0.04 | — | — | — | — | — | — | — | — |

TABLE 12

| | | | | High Temperature Strength (900° C.) | | | High Temperature Strength (1000° C.) | | | Thermal Fatigue Property (900° C.) | |
|---|---|---|---|---|---|---|---|---|---|---|---|
| | | | | | 0.2% | | | 0.2% | | | |
| | Sample No. | Casting Property | Grain Size (μm) | Tesile Strength (MPa) | Yield Strength (MPa) | Elongation (%) | Tensile Strength (MPa) | Yield Strength (MPa) | Elongation (%) | Crack Length (mm) | Dimensional Change (mm) |
| Invention Example | 2 | ○0 | 133 | 58 | 40 | 111 | 30 | 24 | 136 | 0 | 0.4 |
| | 3 | ○0 | 149 | 57 | 40 | 107 | 29 | 23 | 129 | 0 | 0.4 |
| | 6 | ○0 | 175 | 56 | 39 | 114 | 27 | 22 | 133 | 0 | 0.5 |
| | 10 | ○0 | 189 | 54 | 38 | 105 | 25 | 21 | 118 | 0 | 0.6 |
| | 11 | ○0 | 212 | 54 | 37 | 100 | 24 | 21 | 132 | 0 | 0.6 |
| | 12 | ○0 | 229 | 52 | 36 | 101 | 23 | 20 | 120 | 0 | 0.7 |
| | 13 | ○0 | 168 | 56 | 39 | 111 | 28 | 23 | 131 | 0 | 0.5 |
| | 14 | ○0 | 149 | 57 | 40 | 105 | 29 | 23 | 128 | 0 | 0.4 |
| | 20 | ○0 | 175 | 56 | 39 | 111 | 27 | 22 | 130 | 0 | 0.5 |
| | 30 | ○0 | 215 | 53 | 37 | 102 | 25 | 21 | 121 | 0 | 0.7 |
| | 31 | ○0 | 138 | 57 | 39 | 107 | 29 | 23 | 135 | 0 | 0.4 |
| | 33 | ○0 | 188 | 54 | 38 | 111 | 26 | 21 | 132 | 0 | 0.6 |
| | 37 | ○1 | 173 | 55 | 38 | 116 | 27 | 22 | 139 | 0 | 0.6 |
| | 40 | ○2 | 248 | 53 | 37 | 108 | 23 | 20 | 124 | 0 | 0.8 |
| | 41 | ○0 | 276 | 52 | 37 | 111 | 23 | 19 | 126 | 0 | 0.9 |
| | 43 | ○0 | 225 | 54 | 36 | 101 | 26 | 22 | 118 | 0 | 0.8 |
| | 44 | ○0 | 238 | 53 | 36 | 106 | 25 | 20 | 119 | 0 | 0.7 |
| | 45 | ○0 | 173 | 55 | 38 | 107 | 27 | 22 | 130 | 0 | 0.6 |
| | 46 | ○0 | 154 | 56 | 39 | 101 | 28 | 22 | 127 | 0 | 0.5 |
| | 52 | ○0 | 180 | 55 | 38 | 107 | 26 | 21 | 129 | 0 | 0.6 |

TABLE 13

| | Sample No. | Casting Property | Grain Size (μm) | High Temperature Strength (900° C.) Tesile Strength (MPa) | High Temperature Strength (900° C.) 0.2% Yield Strength (MPa) | High Temperature Strength (900° C.) Elongation (%) | High Temperature Strength (1000° C.) Tensile Strength (MPa) | High Temperature Strength (1000° C.) 0.2% Yield Strength (MPa) | High Temperature Strength (1000° C.) Elongation (%) | Thermal Fatigue Property (900° C.) Crack Length (mm) | Thermal Fatigue Property (900° C.) Dimensional Change (mm) |
|---|---|---|---|---|---|---|---|---|---|---|---|
| Comparative Example | 2 | x | 456 | — | — | — | — | — | — | — | — |
| | 3 | ○11 | 484 | 34 | 9 | 53 | 17 | 4 | 59 | 2.4 | 0.3 |
| | 6 | ○21 | 530 | 33 | 8 | 57 | 16 | 4 | 61 | 3.0 | 0.5 |
| | 10 | ○10 | 512 | 30 | 15 | 51 | 15 | 10 | 49 | 1.5 | 0.4 |
| | 11 | ○12 | 535 | 30 | 14 | 46 | 14 | 9 | 63 | 2.2 | 0.4 |
| | 12 | ○13 | 492 | 33 | 15 | 56 | 15 | 10 | 52 | 1.9 | 0.4 |
| | 13 | ○14 | 503 | 32 | 14 | 62 | 15 | 10 | 55 | 2.1 | 0.4 |
| | 14 | ○20 | 484 | 34 | 9 | 53 | 17 | 4 | 59 | 3.1 | 0.2 |
| | 20 | ○14 | 530 | 33 | 8 | 55 | 16 | 4 | 60 | 3.2 | 0.3 |
| | 30 | ○13 | 538 | 29 | 14 | 48 | 15 | 9 | 52 | 1.8 | 0.5 |
| | 31 | ○17 | 461 | 33 | 16 | 53 | 19 | 11 | 66 | 1.7 | 0.2 |
| | 33 | ○12 | 511 | 30 | 15 | 57 | 16 | 9 | 63 | 1.7 | 0.4 |
| | 37 | ○10 | 496 | 31 | 15 | 62 | 17 | 10 | 70 | 3.0 | 0.4 |
| | 40 | ○15 | 571 | 29 | 14 | 54 | 13 | 8 | 55 | 2.7 | 0.6 |
| | 41 | ○21 | 599 | 28 | 14 | 57 | 13 | 7 | 57 | 2.5 | 0.7 |
| | 43 | ○14 | 548 | 30 | 13 | 47 | 16 | 10 | 49 | 2.6 | 0.6 |
| | 44 | ○11 | 561 | 29 | 13 | 52 | 15 | 8 | 50 | 2.4 | 0.5 |
| | 45 | ○12 | 526 | 31 | 14 | 49 | 16 | 11 | 51 | 2.2 | 0.5 |
| | 46 | ○12 | 477 | 32 | 16 | 47 | 18 | 10 | 58 | 1.8 | 0.3 |
| | 52 | ○20 | 503 | 31 | 15 | 53 | 16 | 9 | 60 | 2.2 | 0.4 |

As shown in Tables 12 and 13, from comparison with comparative examples, it is found that in samples of the invention where the thinning is applied by use of the low-pressure casting method, an average grain size is largely reduced compared with these of comparative examples and the high temperature tensile test characteristics and high temperature fatigue characteristics are drastically improved.

While the present invention has been described in detail and with reference to specific embodiments thereof, it will be apparent to one skilled in the art that various changes and modifications can be made therein without departing from the spirit and scope thereof.

The present application is based on Japanese Patent Applications No. 2006-047354 and No. 2006-047355 both filed on Feb. 23, 2006, and the contents thereof are incorporated herein by reference.

What is claimed is:

1. A ferritic stainless steel cast iron consisting of:

C: 0.20 to 0.37 mass %;

Si: 1.00 to 3.00 mass %;

Mn: 0.30 to 3.00 mass %;

Cr: 12.0 to 22.0 mass %; and

W: 0.10 to 5.00 mass %;

one of Nb and V, or both of Nb and V in total: 1.5 to 5.0 mass %;

optionally consisting of Cu: 0.02 to 2.00 mass %, Co: 0.01 to 5.00 mass %, Mo: 0.05 to 5.00 mass %, S: 0.01 to 0.50 mass %, N: 0.01 to 0.15 mass %, P: 0.50 mass % or less, B: 0.005 to 0.100 mass %, Ca: 0.005 to 0.100 mass %, Ta: 0.01 to 1.00 mass %, Ti: 0.01 to 1.00 mass %, Al: 0.01 to 1.00 mass %, Zr: 0.01 to 0.20 mass %, and one or more of Sc, Y, La, Ce, Pr, Nd, Sm, Eu, Gd, Tb, Dy, Ho, Er, Tm, Yb and Lu in total of 0.005 to 0.100 mass % and balance Fe;

wherein the ferritic stainless steel cast iron satisfying the following formula (1):

$$1400 \leqq 1562.3-\{133WC+14WSi+5WMn+10(WNb+WV)\} \leqq 1480 \quad (1)$$

wherein, WC (mass %), WSi (mass %), WMn (mass %), WNb (mass %) and WV (mass %) are contents of C, Si, Mn, Nb and V, respectively.

2. The ferritic stainless steel cast iron according to claim 1, wherein the ferritic stainless steel cast iron satisfies the following formula (2):

$$900 \leqq -31.6-200WC+143WSi-111WMn+67WCr-90(WNb+WV) \quad (2)$$

and wherein WCr represents the content of Cr in mass %.

3. The ferritic stainless steel cast iron according to claim 2, wherein the ferritic stainless steel cast iron satisfies the following formula (4):

$$792+47WC-138WSi-16WCr-23(WNb+WV) \leqq 300 \quad (4).$$

4. The ferritic stainless steel cast iron according to claim 3, wherein the ferritic stainless steel cast iron further consisting of Cu: 0.02 to 2.00 mass %, and the ferritic stainless steel cast iron satisfies the following formula (5):

$$3WCr+118WCu>55 \quad (5)$$

wherein WCu represents the content of Cu in mass %.

5. The ferritic stainless steel cast iron according to claim 4, wherein the ferritic stainless steel cast iron further consisting of at least one element selected from the group consisting of:

Co: 0.01 to 5.00 mass %; and

Mo: 0.05 to 5.00 mass %.

6. The ferritic stainless steel cast iron according to claim 5, wherein the ferritic stainless steel cast iron further consisting of at least one element selected from the group consisting of:

S: 0.01 to 0.50 mass %;

N: 0.01 to 0.15 mass %; and

P: 0.50 mass % or less.

7. The ferritic stainless steel cast iron according to claim 4, wherein the ferritic stainless steel cast iron further consisting of at least one element selected from the group consisting of:

S: 0.01 to 0.50 mass %;

N: 0.01 to 0.15 mass %; and

P: 0.50 mass % or less.

8. The ferritic stainless steel cast iron according to claim 3, wherein the ferritic stainless steel cast iron further consisting of at least one element selected from the group consisting of:

Co: 0.01 to 5.00 mass %; and

Mo: 0.05 to 5.00 mass %.

9. The ferritic stainless steel cast iron according to claim 8, wherein the ferritic stainless steel cast iron further consisting of at least one element; selected from the group consisting of:

S: 0.01 to 0.50 mass %;

N: 0.01 to 0.15 mass %; and

P: 0.50 mass % or less.

10. The ferritic stainless steel cast iron according to claim 3, wherein the ferritic stainless steel cast iron further consisting of at least one element selected from the group consisting of:

S: 0.01 to 0.50 mass %;

N: 0.01 to 0.15 mass %; and

P: 0.50 mass % or less.

11. The ferritic stainless steel cast iron according to claim 2, wherein the ferritic stainless steel cast iron further consisting of Cu: 0.02 to 2.00 mass %, and the ferritic stainless steel cast iron satisfies the following formula (5):

$$3WCr+118WCu>55 \quad (5)$$

wherein WCu represents the content of Cu in mass %.

12. The ferritic stainless steel cast iron according to claim 11, wherein the ferritic stainless steel cast iron further consisting of at least one element selected from the group consisting of:

Co: 0.01 to 5.00 mass %; and

Mo: 0.05 to 5.00 mass %.

13. The ferritic stainless steel cast iron according to claim 12, wherein the ferritic stainless steel cast iron further consisting of at least one element selected from the group consisting of:

S: 0.01 to 0.50 mass %;

N: 0.01 to 0.15 mass %; and

P: 0.50 mass % or less.

14. The ferritic stainless steel cast iron according to claim 11, wherein the ferritic stainless steel cast iron further consisting of at least one element selected from the group consisting of:

S: 0.01 to 0.50 mass %;

N: 0.01 to 0.15 mass %; and

P: 0.50 mass % or less.

15. The ferritic stainless steel cast iron according to claim 2, wherein the ferritic stainless steel cast iron further consisting of at least one element selected from the group consisting of:

Co: 0.01 to 5.00 mass %; and

Mo: 0.05 to 5.00 mass %.

16. The ferritic stainless steel cast iron according to claim 15, wherein the ferritic stainless steel cast iron further consisting of at least one element selected from the group consisting of:

S: 0.01 to 0.50 mass %;

N: 0.01 to 0.15 mass %; and

P: 0.50 mass % or less.

17. The ferritic stainless steel cast iron according claim 2, wherein the ferritic stainless steel cast iron further consisting of at least one element selected from the group consisting of:

S: 0.01 to 0.50 mass %;

N: 0.01 to 0.15 mass %; and

P: 0.50 mass % or less.

18. The ferritic stainless steel cast iron according to claim 1, wherein the ferritic stainless steel cast iron satisfies the following formula (3):

$$1050 \leqq -31.6-200WC+143WSi-111WMn+67WCr-90(WNb+WV) \quad (3)$$

wherein WCr represents the content of Cr in mass %.

19. The ferritic stainless steel cast iron according to claim 1, wherein the ferritic stainless steel cast iron satisfies the following formula (4):

$$792+47WC-138WSi-16WCr-23(WNb+WV) \leqq 300 \quad (4)$$

wherein WCr represents the content of Cr in mass %.

20. The ferritic stainless steel cast iron according to claim 1, wherein the ferritic stainless steel cast iron further consisting of Cu: 0.02 to 2.00 mass %, the ferritic stainless steel cast iron satisfies the following formula (5):

$$3WCr+118WCu>55 \quad (5)$$

and wherein WCu represents the content of Cu in mass % wherein WCr represents the content of Cr in mass %.

21. The ferritic stainless steel cast iron according to claim 20, wherein the ferritic stainless steel cast iron further consisting of at least one element selected from the group consisting of:

Co: 0.01 to 5.00 mass %; and

Mo: 0.05 to 5.00 mass %.

22. The ferritic stainless steel cast iron according to claim 20, wherein the ferritic stainless steel cast iron further consisting of at least one element selected from the group consisting of:

S: 0.01 to 0.50 mass %;

N: 0.01 to 0.15 mass %; and

P: 0.50 mass % or less.

23. The ferritic stainless steel cast iron according to claim 1, wherein the ferritic stainless steel cast iron further consisting of at least one element selected from the group consisting of:

Co: 0.01 to 5.00 mass %; and

Mo: 0.05 to 5.00 mass %.

24. The ferritic stainless steel cast iron according to claim 23, wherein the ferritic stainless steel cast iron further consisting of at least one element selected from the group consisting of:

S: 0.01 to 0.50 mass %;

N: 0.01 to 0.15 mass %; and

P: 0.50 mass % or less.

25. The ferritic stainless steel cast iron according to claim 1, wherein the ferritic stainless steel cast iron further consisting of at least one element selected from the group consisting of:

S: 0.01 to 0.50 mass %;

N: 0.01 to 0.15 mass %; and

P: 0.50 mass % or less.

26. A process for producing a cast part, the process comprising:

casting a melt of the ferritic stainless steel cast iron according to claim 1 into a sand mold having the shape of the cast part by a low-pressure casting method.

27. The process for producing a cast part according to claim 26, wherein the cast part comprises a thin portion having a thickness of 1 to 5 mm.

28. The process for producing a cast part according to claim 27, wherein the ferritic stainless steel cast iron further consisting of Cu: 0.02 to 2.00 mass %, the ferritic stainless steel cast iron satisfies the following formulae (2), (4) and (5):

$$900 \leqq -31.6-200WC+143WSi-111WMn+67WCr-90(WNb+WV) \quad (2)$$

$$792+47WC-138WSi-16WCr-23(WNb+WV)<300 \quad (4)$$

$$3WCr+118WCu>55 \quad (5)$$

wherein WCu represents the content of Cu in mass % wherein WCr represents the content of Cr in mass % and the ferritic stainless steel cast iron further consisting of at least one element selected from the group consisting of:

Co: 0.01 to 5.00 mass %;

Mo: 0.05 to 5.00 mass %;

S: 0.01 to 0.50 mass %;

N: 0.01 to 0.15 mass %;

P: 0.50 mass % or less;

B: 0.005 to 0.100 mass %;

Ca: 0.005 to 0.100 mass %;

Ta: 0.01 to 1.00 mass %;

Ti: 0.01 to 1.00 mass %;

Al: 0.01 to 1.00 mass %;

Zr: 0.01 to 0.20 mass %; and one or more of Sc, Y, La, Ce, Pr, Nd, Sm, Eu, Gd, Tb, Dy, Ho, Er, Tm, Yb and Lu, totaling 0.005 to 0.100 mass %.

29. A cast part comprising the ferritic stainless steel cast iron according to claim 1.

30. The cast part according to claim 29, wherein the cast part comprises a thin portion having a thickness of 1 to 5 mm.

31. The cast part according to claim 30, wherein the ferritic stainless steel cast iron satisfies the following formula (2):

$$900 \leqq -31.6-200WC+143WSi-111WMn+67WCr-90(WNb+WV) \quad (2)$$

wherein WCr represents the content of Cr in mass %.

32. The cast part according to claim 31, wherein the ferritic stainless steel cast iron satisfies the following formula (4):

$$792+47WC-138WSi-16WCr-23(WNb+WV) \leqq 300 \quad (4)$$

wherein WCr represents the content of Cr in mass %.

33. The cast part according to claim 32, wherein the ferritic stainless steel cast iron further consisting of Cu: 0.02 to 2.00 mass %, the ferritic stainless steel cast iron satisfies the following formula (5):

$$3WCr+118WCu>55 \quad (5)$$

wherein WCu represents the content of Cu in mass %.

34. The cast part according to claim 33, wherein the ferritic stainless steel cast iron further consisting of at least one element selected from the group consisting of:

Co: 0.01 to 5.00 mass %; and

Mo: 0.05 to 5.00 mass %.

35. The cast part according to claim 34, wherein the ferritic stainless steel cast iron further consisting of at least one election selected from the group consisting of:

S: 0.01 to 0.50 mass %;

N: 0.01 to 0.15 mass %; and

P: 0.50 mass % or less.

36. The cast part according to claim 33, wherein the ferritic stainless steel cast iron further consisting of at least one element selected from the group consisting of:

S: 0.01 to 0.50 mass %;

N: 0.01 to 0.15 mass %; and

P: 0.50 mass % or less.

37. The cast part according to claim 32, wherein the ferritic stainless steel cast iron further consisting of at least one element selected from the group consisting of:

Co: 0.01 to 5.00 mass %; and

Mo: 0.05 to 5.00 mass %.

38. The cast part according to claim 37, wherein the ferritic stainless steel cast iron further consisting of at least one element selected from the group consisting of:

S: 0.01 to 0.50 mass %;

N: 0.01 to 0.15 mass %; and

P: 0.50 mass % or less.

39. The cast part according to claim 32, wherein the ferritic stainless steel cast iron further consisting of at least one element selected from the group consisting of:

S: 0.01 to 0.50 mass %;

N: 0.01 to 0.15 mass %; and

P: 0.50 mass % or less.

40. The cast part according to claim 31, wherein the ferritic stainless steel cast iron further consisting of Cu: 0.02 to 2.00 mass %, the ferritic stainless steel cast iron satisfies the following formula (5):

$$3WCr+118WCu>55 \quad (5)$$

wherein WCu represents the content of Cu in mass %.

41. The cast part according to claim 40, wherein the ferritic stainless steel cast iron further consisting of at least one element selected from the group consisting of:

Co: 0.01 to 5.00 mass %; and

Mo: 0.05 to 5.00 mass %.

42. The cast part according to claim 41, wherein the ferritic stainless steel cast iron further consisting of at least one element selected from the group consisting of:

S: 0.01 to 0.50 mass %;

N: 0.01 to 0.15 mass %; and

P: 0.50 mass % or less.

43. The cast part according to claim 40, wherein the ferritic stainless steel cast iron further consisting of at least one element selected from the group consisting of:

S: 0.01 to 0.50 mass %;

N: 0.01 to 0.15 mass %; and

P: 0.50 mass % or less.

44. The cast part according to claim 31, wherein the ferritic stainless steel cast iron further consisting of at least one element selected from the group consisting of:

Co: 0.01 to 5.00 mass %; and

Mo: 0.05 to 5.00 mass %.

45. The cast part according to claim 44, wherein the ferritic stainless steel cast iron further consisting of at least one element selected from the group consisting of:

S: 0.01 to 0.50 mass %;

N: 0.01 to 0.15 mass %; and

P: 0.50 mass % or less.

46. The cast part according to claim 31, wherein the ferritic stainless steel cast iron further consisting of least one element selected from the group consisting of:

S: 0.01 to 0.50 mass %;

N: 0.01 to 0.15 mass %; and

P: 0.50 mass % or less.

47. The cast part according to claim 30, wherein the ferritic stainless steel cast iron satisfies the following formula (3):

$$1050 \leqq -31.6-200WC+143WSi-111WMn+67WCr-90(WNb+WV) \quad (3)$$

wherein WCr represents the content of Cr in mass %.

48. The cast part according to claim 30, wherein the ferritic stainless steel cast iron satisfies the following formula (4):

$$792+47WC-138WSi-16WCr-23(WNb+WV)\leqq 300 \quad (4)$$

wherein WCr represents the content of Cr in mass %.

49. The cast part according to claim 30, wherein the ferritic stainless steel cast iron further consisting of Cu: 0.02 to 2.00 mass %, the ferritic stainless steel cast iron satisfies the following formula (5):

$$3WCr+118WCu>55 \quad (5)$$

wherein WCu represents the content of Cu in mass % wherein WCr represents the content of Cr in mass %.

50. The cast part according to claim 49, wherein the ferritic stainless steel cast iron further consisting of at least one element selected from the group consisting of:

Co: 0.01 to 5.00 mass %; and

Mo: 0.05 to 5.00 mass %.

51. The cast part according to claim 49, wherein the ferritic stainless steel cast iron further consisting of at least one element selected from the group consisting of:

S: 0.01 to 0.50 mass %;

N: 0.01 to 0.15 mass %; and

P: 0.50 mass % or less.

52. The cast part according to claim 30, wherein the ferritic stainless steel cast iron further consisting of at least one element selected from the group consisting of:

Co: 0.01 to 5.00 mass %; and

Mo: 0.05 to 5.00 mass %.

53. The cast part according to claim 52, wherein the ferritic stainless steel cast iron further consisting of at least one element selected from the group consisting of:

S: 0.01 to 0.50 mass %;

N: 0.01 to 0.15 mass %; and

P: 0.50 mass % or less.

54. The cast part according to claim 30, wherein the ferritic stainless steel cast iron further consisting of at least one element selected from the group consisting of:

S: 0.01 to 0.50 mass %;

N: 0.01 to 0.15 mass %; and

P: 0.50 mass % or less.

55. The cast part according to claim 35, wherein the ferritic stainless steel cast iron further consisting of at least one element selected from the group consisting of:

B: 0.005 to 0.100 mass %;

Ca: 0.005 to 0.100 mass %;

Ta: 0.01 to 1.00 mass %;

Ti: 0.01 to 1.00 mass %;

Al: 0.01 to 1.00 mass %;

Zr: 0.01 to 0.20 mass %; and one or more of Sc, Y, La, Ce, Pr, Nd, Sm, Eu, Gd, Tb, Dy, Ho, Er, Tm, Yb and Lu, totaling 0.005 to 0.100 mass %.

* * * * *